US005671680A

United States Patent [19]

DelGreco

[11] Patent Number: 5,671,680

[45] Date of Patent: Sep. 30, 1997

[54] GUIDANCE DEVICE FOR A TRACK-FOLLOWING VEHICLE AND METHOD OF GUIDING A TRACK-FOLLOWING VEHICLE

[76] Inventor: Anthony Armand DelGreco, 160 Cabrini Blvd., Apt. 78, New York, N.Y. 10033

[21] Appl. No.: 657,421

[22] Filed: Jun. 3, 1996

[51] Int. Cl.[6] ..... E01B 25/00

[52] U.S. Cl. ..... 104/130.07; 104/243

[58] Field of Search ..... 104/130.07, 243

[56] References Cited

U.S. PATENT DOCUMENTS

| | | | |
|---|---|---|---|
| 426,751 | 4/1890 | Appleyard . | |
| 556,624 | 3/1896 | Flint . | |
| 2,879,718 | 3/1959 | Eksergian | 105/185 |
| 3,593,665 | 7/1971 | Marty | 104/130.07 |
| 3,593,668 | 7/1971 | Adams | 104/120 |
| 3,628,462 | 12/1971 | Holt | 104/105 |
| 3,759,187 | 9/1973 | Gayot | 104/130.07 |
| 3,783,793 | 1/1974 | Perrott et al. | 104/130.01 |
| 3,828,691 | 8/1974 | Purath | 105/145 |
| 3,831,527 | 8/1974 | Peterson | 104/130.07 |
| 3,841,225 | 10/1974 | Johnson | 104/130.01 |
| 3,845,719 | 11/1974 | Langdon | 104/130.07 |
| 3,890,904 | 6/1975 | Edwards . | |
| 3,913,491 | 10/1975 | Auer, Jr. et al. | 104/130.07 |
| 4,041,876 | 8/1977 | Michel | 104/130.07 |
| 4,295,428 | 10/1981 | Dickhart, III et al. | 105/168 |
| 4,300,454 | 11/1981 | Scheffel | 105/168 |
| 4,394,837 | 7/1983 | Edwards . | |
| 4,428,301 | 1/1984 | Jackson | 105/168 |
| 4,476,787 | 10/1984 | Edwards . | |
| 4,512,261 | 4/1985 | Horger | 105/167 |
| 4,526,107 | 7/1985 | Mautner et al. | 105/133 |
| 4,671,185 | 6/1987 | Anderson et al. | 104/130.07 |
| 4,862,807 | 9/1989 | Guadagno | 104/130.07 |
| 5,024,163 | 6/1991 | Lenz | 104/243 |
| 5,114,073 | 5/1992 | Dearien, Jr. . | |
| 5,131,332 | 7/1992 | Smith | 105/224.05 |
| 5,277,124 | 1/1994 | DiFonso et al. | 104/130.07 |

FOREIGN PATENT DOCUMENTS

| | | | |
|---|---|---|---|
| 2246389 | 4/1973 | Germany | 104/130.07 |

*Primary Examiner*—S. Joseph Morano

*Attorney, Agent, or Firm*—Stephen P. Kearney, Atty.

[57] ABSTRACT

The invention is a guidance device for a railway vehicle and, more generally, is a guidance device for any track-following vehicle. The guidance device has a guide wheel which is complementary with a substantially circular guide rail, and which is capable of pivoting about the guide rail from rotation about a substantially horizontal axis to rotation about a non-horizontal axis. The guide wheel is pivoted by a pivoting member to which the guide wheel is mounted. The substantially circular guide rail extends parallel to the main rails of the track and is located at least in the area of a bend in the track, e.g., a branch in the track, a curve in the track, or the like. The guide rail is preferably positioned laterally outboard of one of the main rails of the track. The track may additionally comprise a second guide rail which is positioned laterally outboard of the other main rail of the track. In an alternate embodiment, the track may have a single guide rail positioned between the main rails of the track.

22 Claims, 27 Drawing Sheets (Ref. Fig. 22 Section a-a)

(Ref. Fig. 22 Section b-b)

(Ref. Fig. 22 Section c-c)

(Ref. Fig. 22 Section d-d)

(Ref. Fig. 22 Section e-e)

(Ref. Fig. 22 Section f-f)

(Ref. Fig. 22 Section g-g)

(Ref. Fig. 22 Section a-a)

(Ref. Fig. 22 Section b-b)

(Ref. Fig. 22 Section c-c)

(Ref. Fig. 22 Section d-d)

(Ref. Fig. 22 Section e-e)

(Ref. Fig. 22 Section f-f)

(Ref. Fig. 22 Section g-g)

GUIDANCE DEVICE FOR A TRACK-FOLLOWING VEHICLE AND METHOD OF GUIDING A TRACK-FOLLOWING VEHICLE

FIELD OF THE INVENTION

This invention relates to a guidance device or switching device that may be used to direct a track-following vehicle to switch from one path of travel on a fixed guideway to an alternate path of travel on the fixed guideway. More particularly, this invention relates to a vehicle-controlled guidance device for a track-following vehicle in which the tracks or rails of the switch remain in a stationary position and the direction taken by each vehicle traveling on the tracks is determined by the shifting of certain components contained within the vehicle itself. The vehicle-controlled guidance device of the present invention may also be used to assist a track-following vehicle in negotiating changes in the direction of a fixed guideway (e.g., track bends or curves). The device described consists of at least one substantially circular, stationary rail and at least one guide wheel which is complementary with and pivots about the substantially circular, stationary rail.

BACKGROUND OF THE INVENTION

Track-following vehicles are commonly used in material handling systems, mining operations, amusement park rides, the transportation of goods and passengers, and the like. The most commonly known track-following vehicles are railway vehicles which travel upon a track comprising pairs of parallel, elevated rails.

Generally, track-following vehicles are switched by moving the track or other elements of the guideway to redirect the vehicle. However, vehicle controlled guidance devices or switching devices are also known in the art. The terms "guidance device" and "switching device" may be used interchangeably herein.

Vehicle-controlled switching devices are switching devices wherein the tracks at the switching point remain in a stationary position and the vehicles traveling on the tracks possess mechanisms which determine the direction of travel at the switch. The primary purpose of such devices is to allow consecutive vehicles traveling on a railway system to travel in different directions at a switch without the need for providing sufficient space and time between the consecutive vehicles to allow the shifting of the switching rails between the passage of the vehicles. This allows the consecutive vehicles to travel in closer proximity to one another and thus increases the traffic capacity of the railway system.

Many of the prior vehicle-controlled switching arrangements utilize complex guideways that if built would require complete replacement of existing railroad track or construction of entirely new dedicated guideways. Other prior vehicle-controlled railway switching arrangements induce abrupt acceleration and deceleration to the guide wheels and therefore to the railway vehicle.

One prior vehicle-controlled switching arrangement avoids the problem of abrupt acceleration and deceleration by providing guide wheels which are in continuous rotation when the vehicle is traveling. However, that invention requires a track configuration in which the two tracks diverge symmetrically from the switch junction and also may require elevations in the tracks. This complicates and possibly prevents the use of that switching arrangement with existing railways.

Therefore, it is an object of the present invention to provide a guidance device for a track-following vehicle which can be used with existing guideways or tracks by making relatively minor modifications to the existing guideways or tracks.

It is also an object of the present invention to provide a guidance device for a track-following vehicle, which does not prevent the use of the track-following vehicle with existing track-based switching devices.

It is also an object of the present invention to provide a guidance device for a track-following vehicle, which provides smooth acceleration and deceleration of the guide wheels.

It is also an object of the present invention to provide a guidance device for a track-following vehicle, having guide wheels which are complementary with a substantially circular guide rail and which continuously rotate while the vehicle is moving.

It is an also object of the present invention to provide a guidance device for a track-following vehicle, which also provides enhanced lateral stability to the track-following vehicle during travel on a curved track.

It is an also object of the present invention to provide an improved method for switching or otherwise guiding a track-following vehicle.

SUMMARY OF THE INVENTION

A guidance device for a railway vehicle intended for use with a track comprising parallel main rails and at least one substantially circular guide rail, is provided. The guidance device comprises at least one guide wheel capable of pivoting outward about the guide rail from rotation about a horizontal axis in a first position to rotation about a non-horizontal axis in a second position, while maintaining a substantially radial orientation relative to the centerpoint of the substantially circular guide rail.

In a preferred embodiment the railway vehicle will comprise at least two such guide wheels positioned to be aligned with substantially circular guide rails on opposite sides of the track.

BRIEF DESCRIPTION OF THE DRAWING

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

Figure 1:
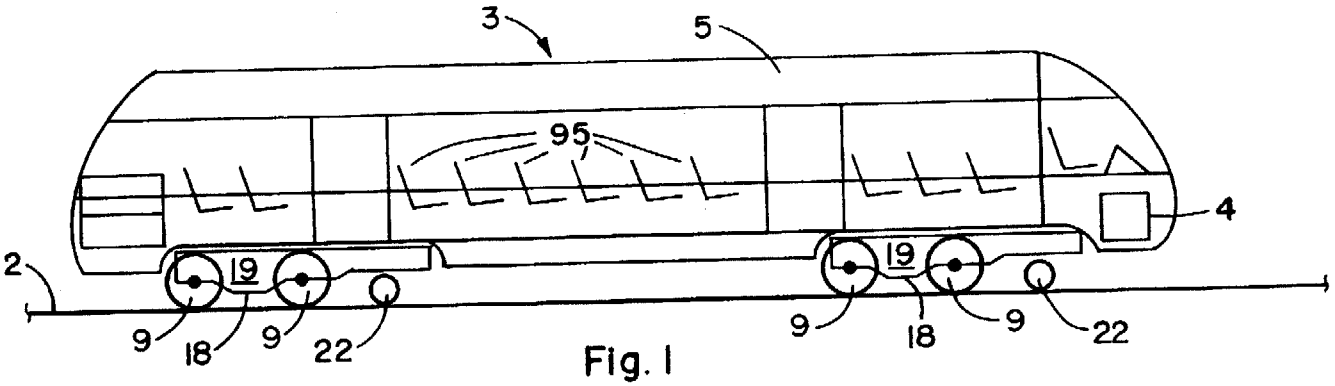
FIG. 1 is a schematic, side view of a preferred railway vehicle embodiment comprising the guidance device of the present invention.
Figure 3:
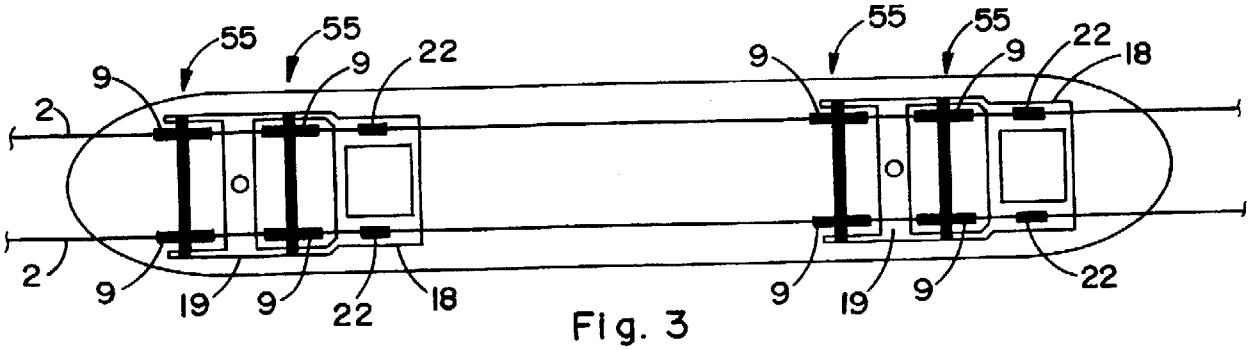
FIG. 3 is a bottom view of the railway vehicle of FIG. 1 showing the trucks of the vehicle, each of which comprises a guidance device of the present invention joined thereto.
Figure 6:
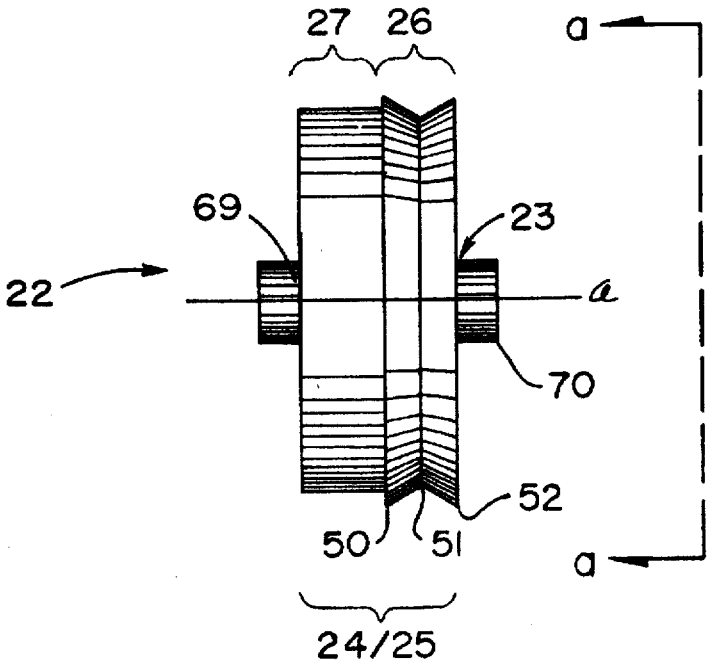
FIG. 6 is a front elevational view of a guide wheel embodiment of the present invention.
Figure 7:
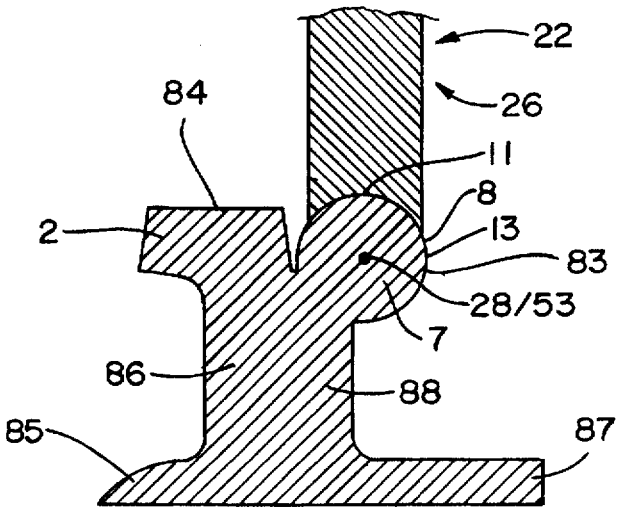
Figure 7A:
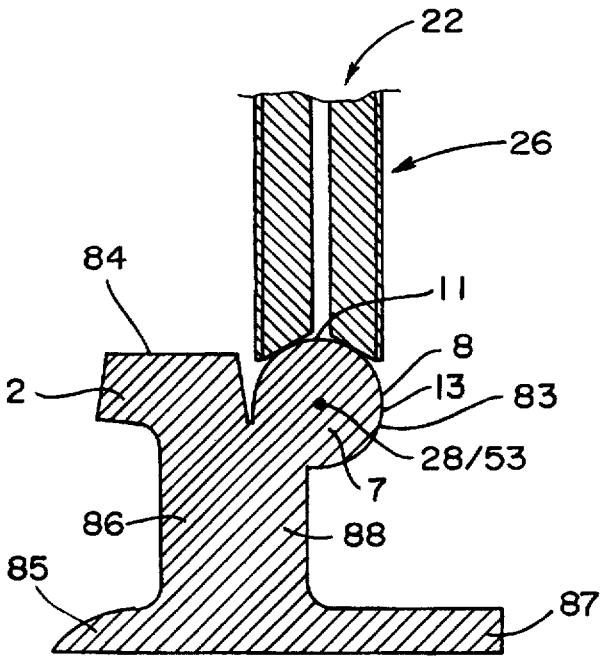
Figure 8:
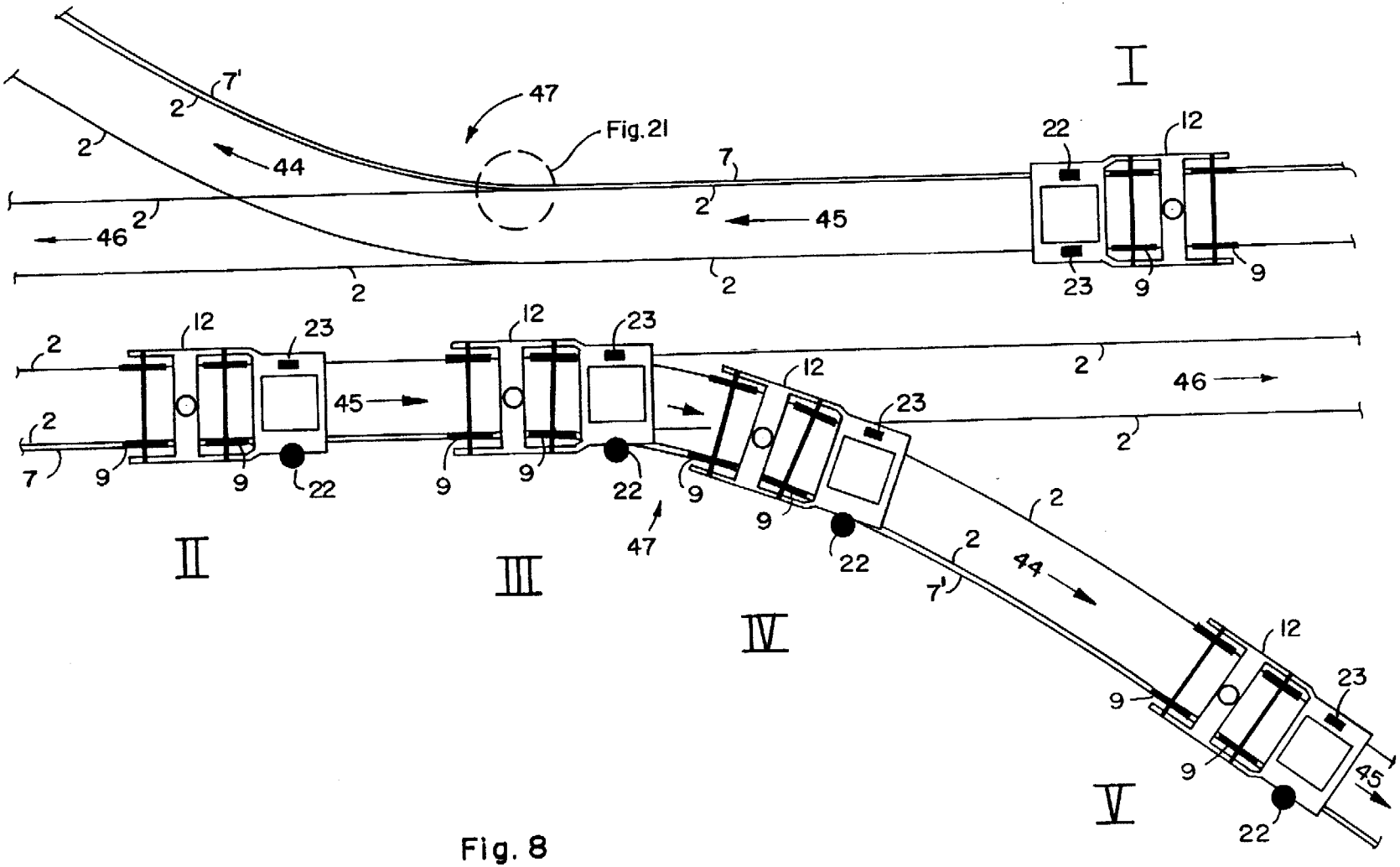
Figure 9:
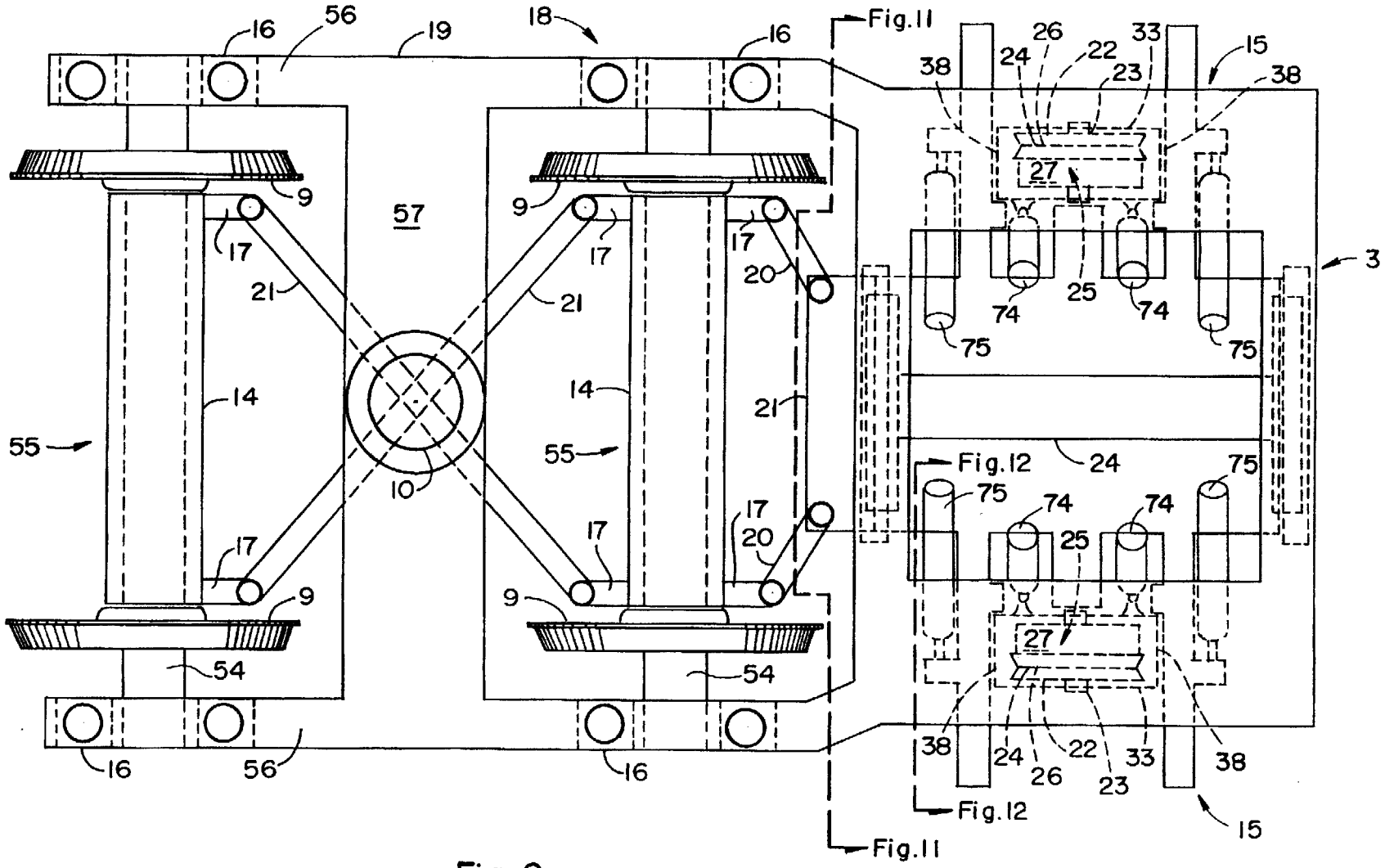
Figure 10:
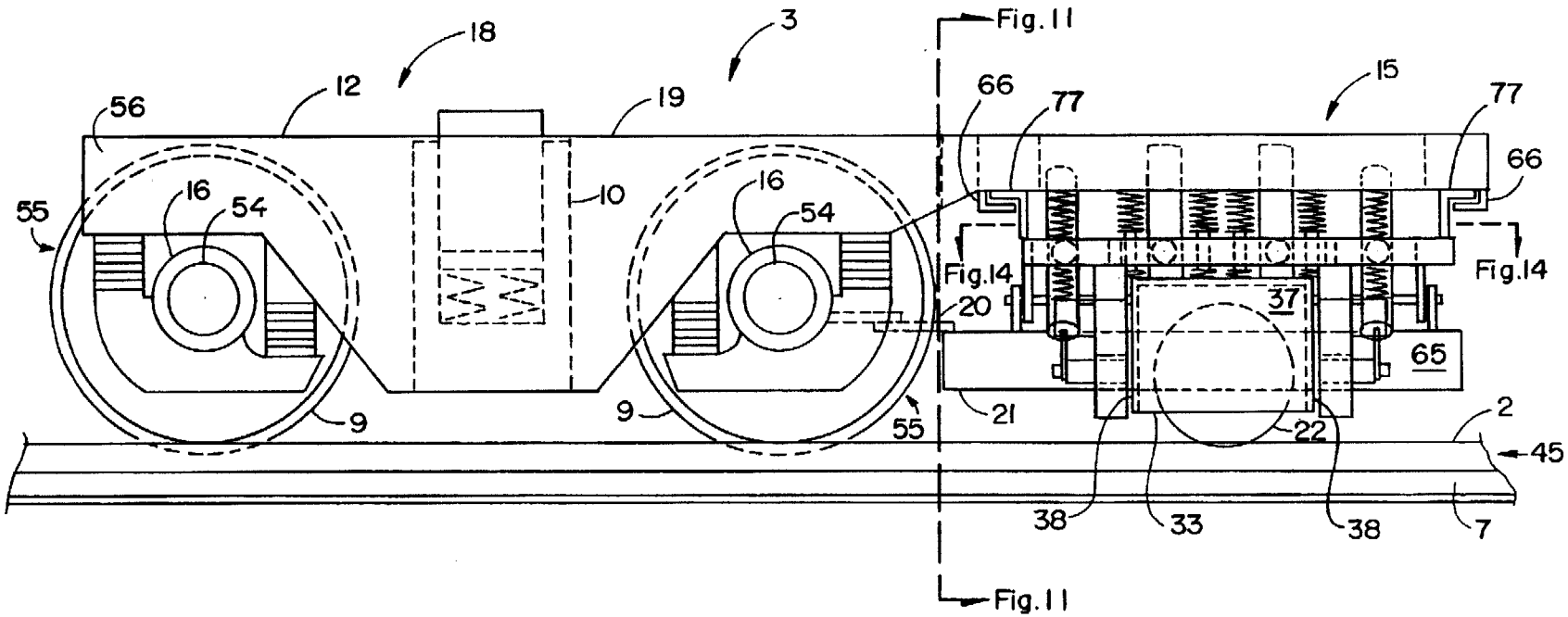
Figure 11:
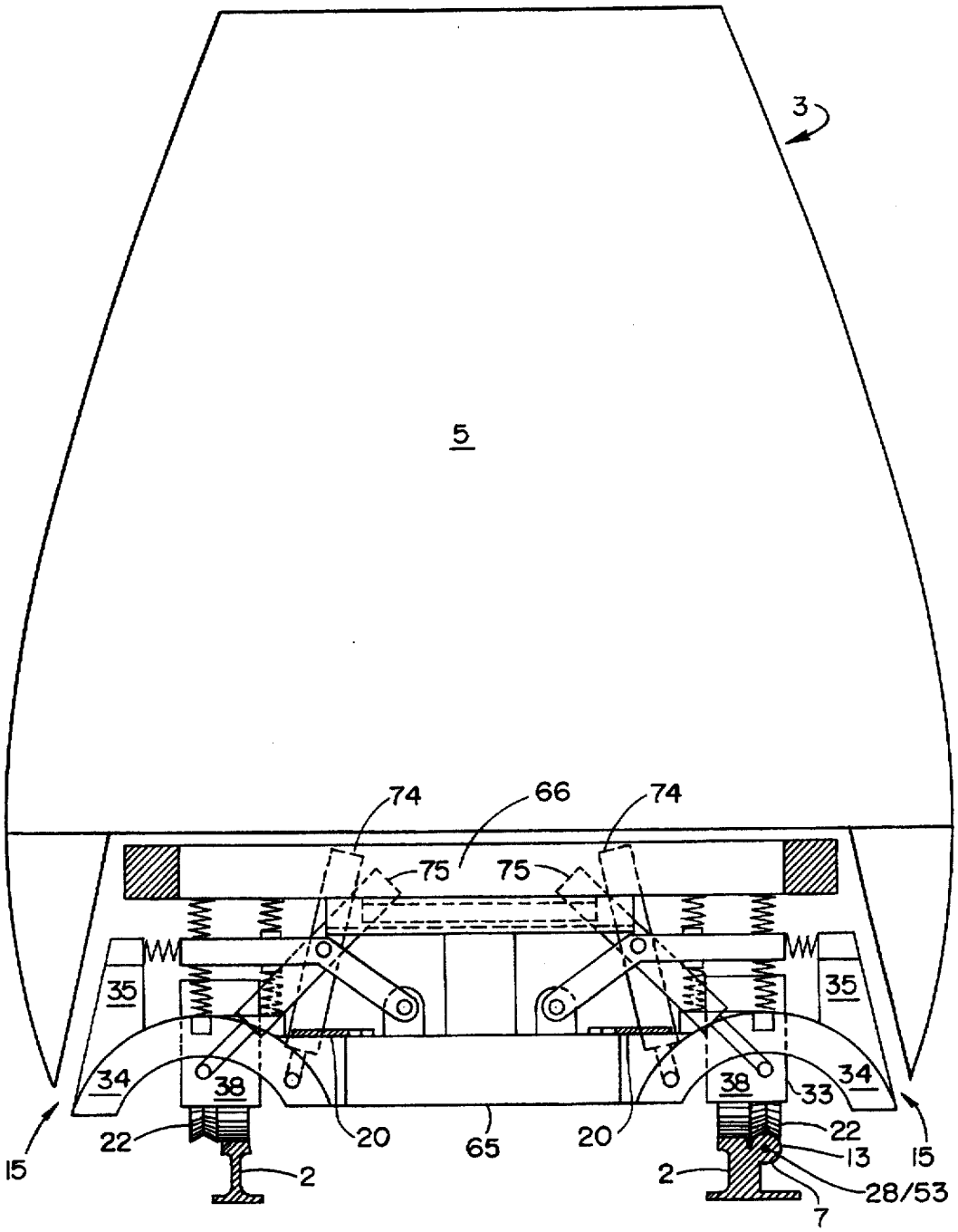
Figure 12:
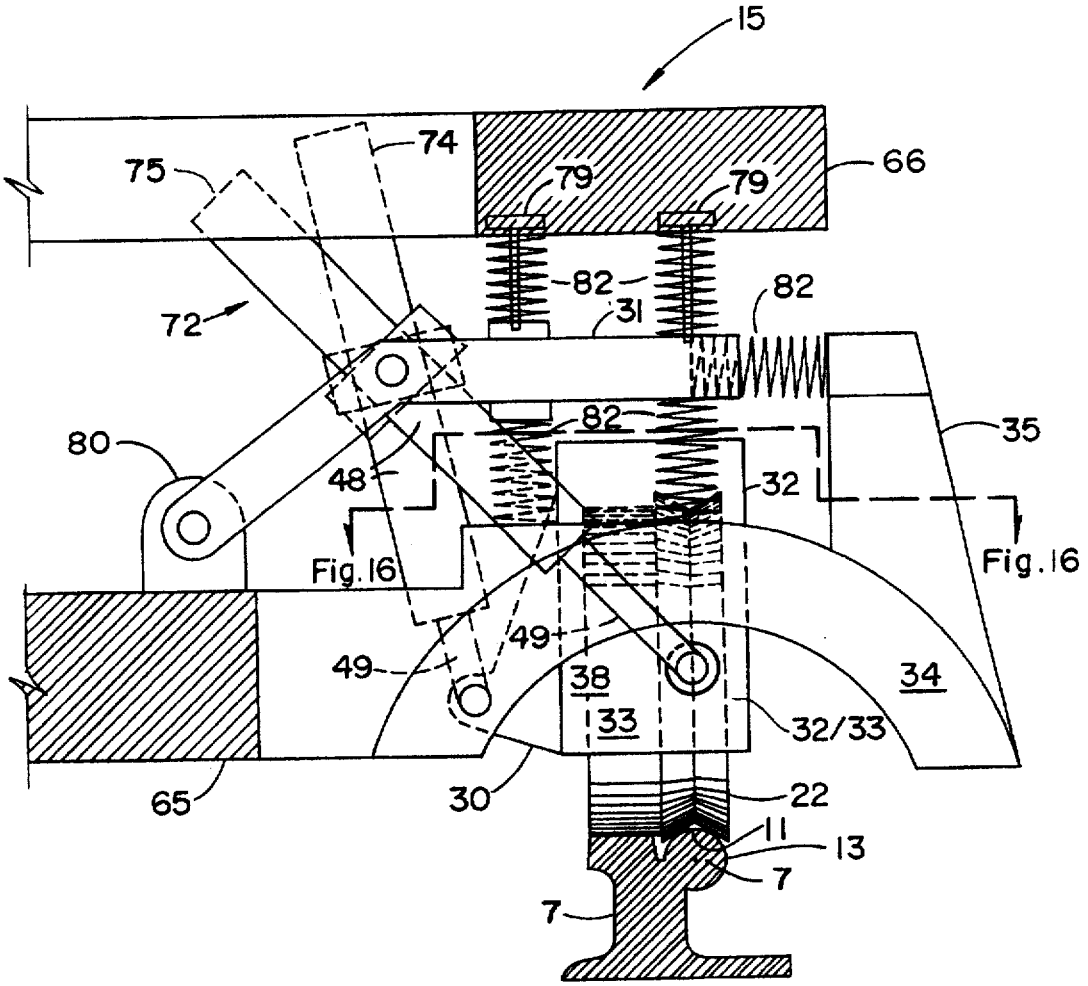
Figure 13:
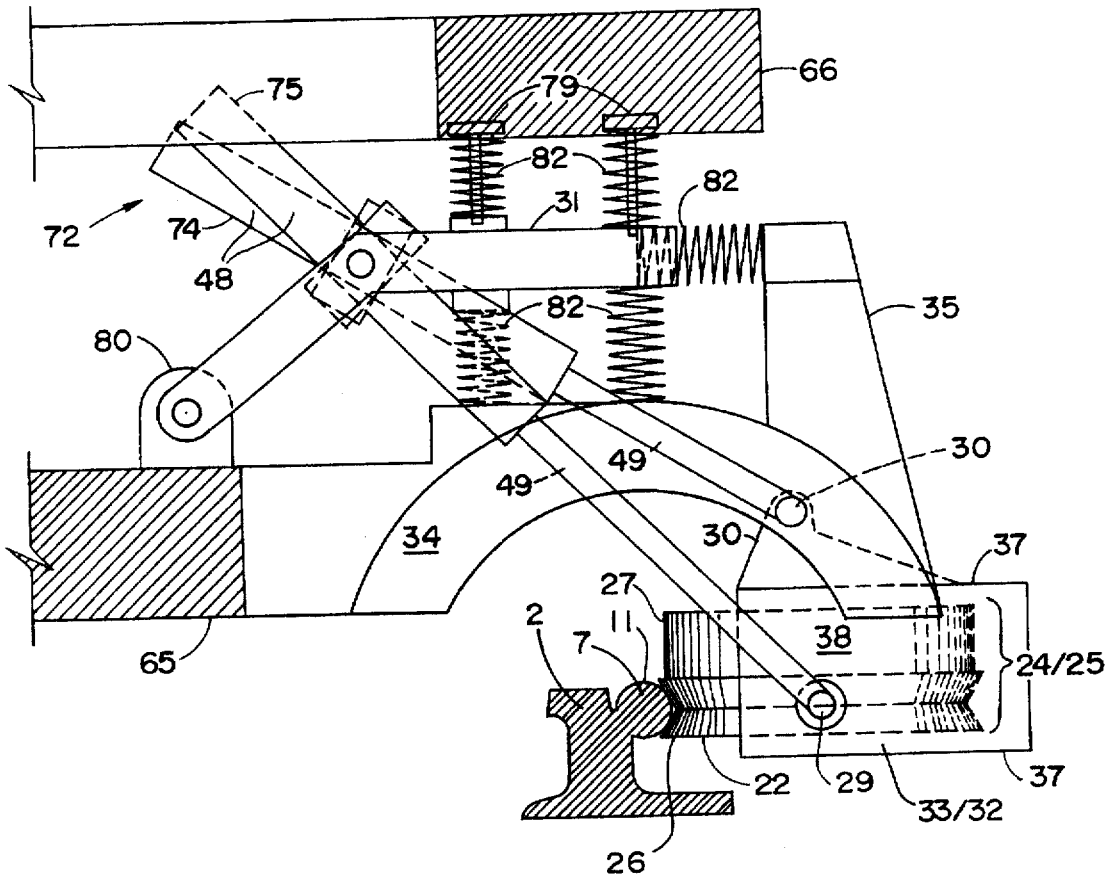
Figure 14:
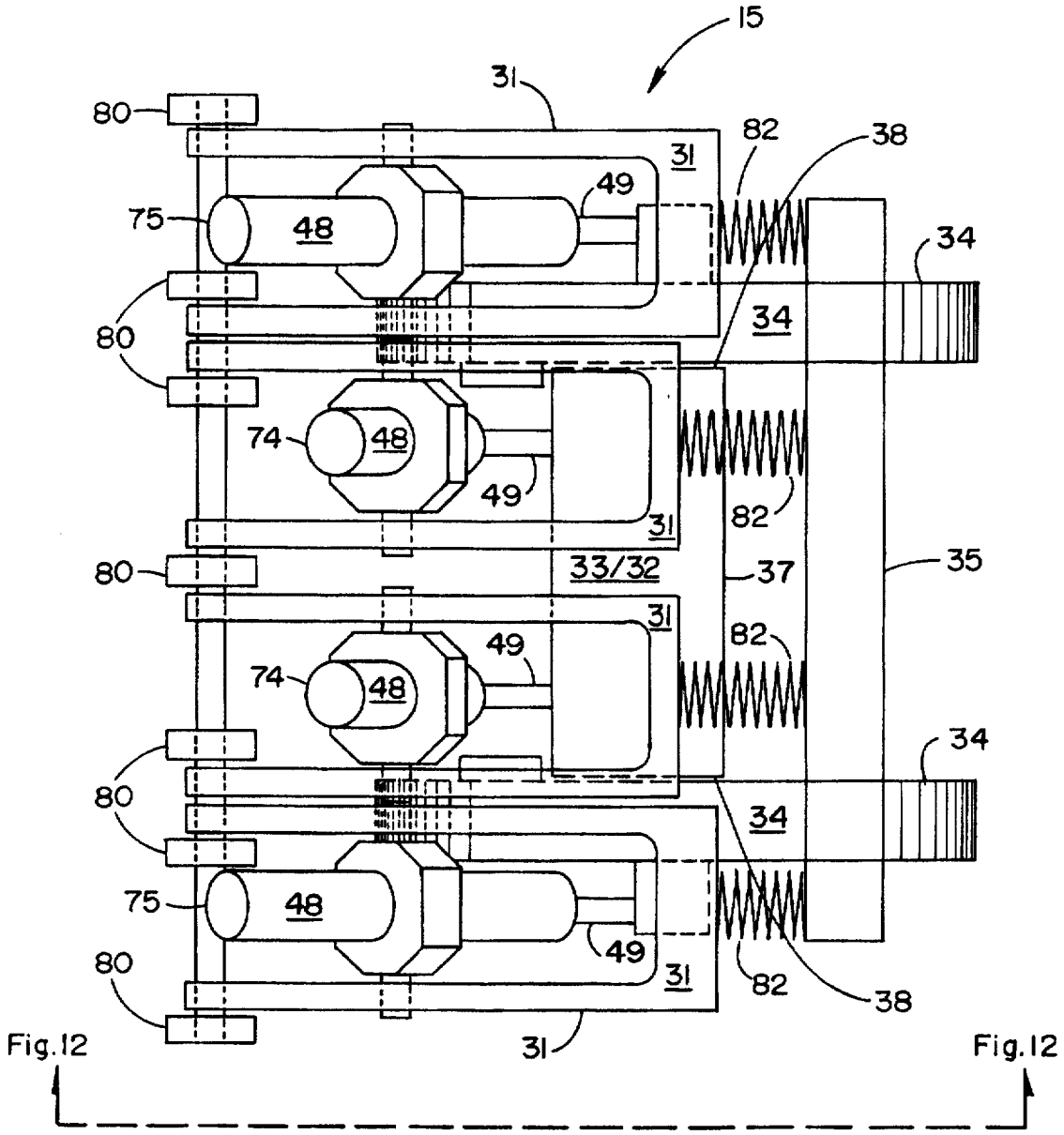
Figure 15:
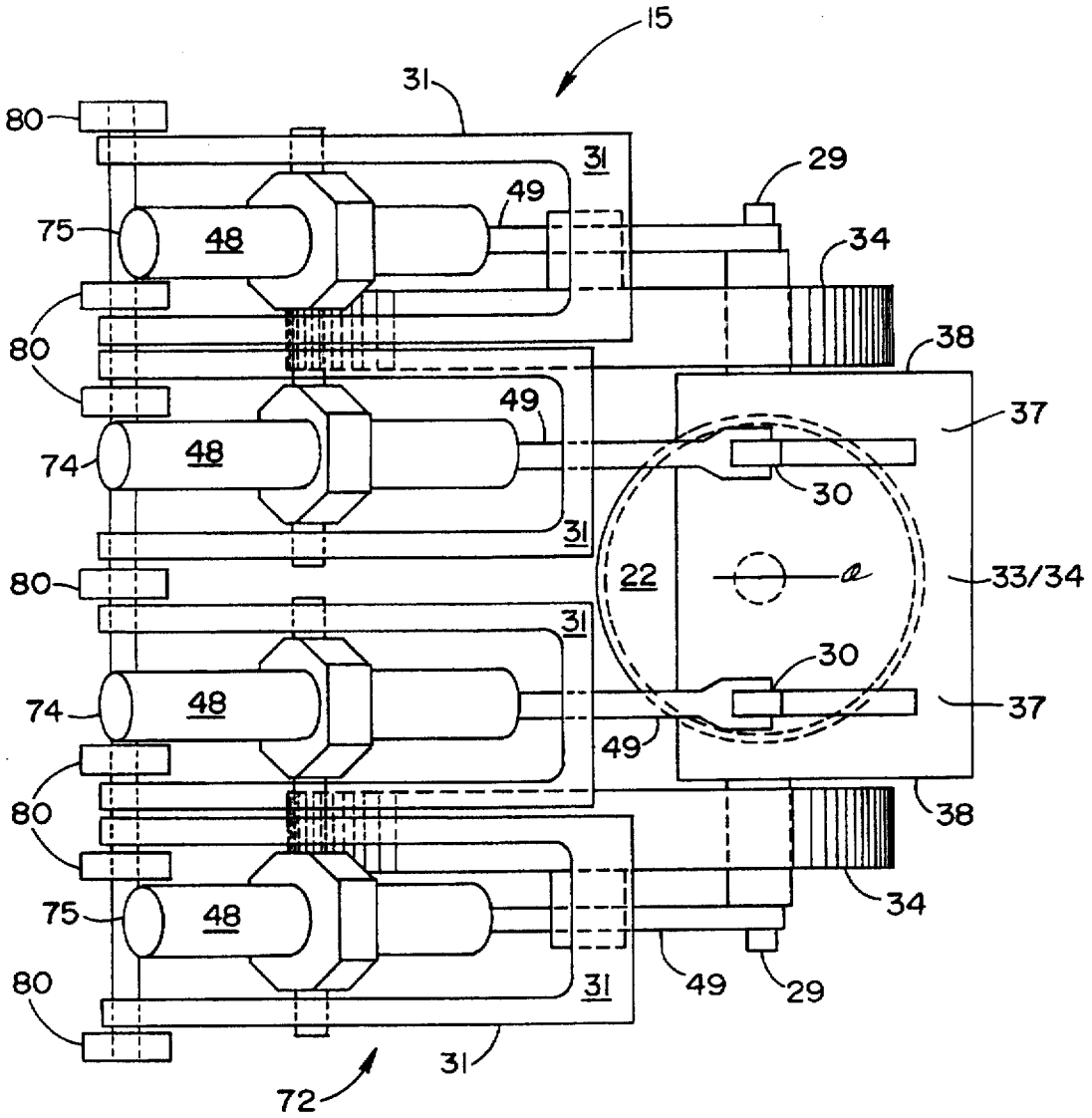
Figure 16:
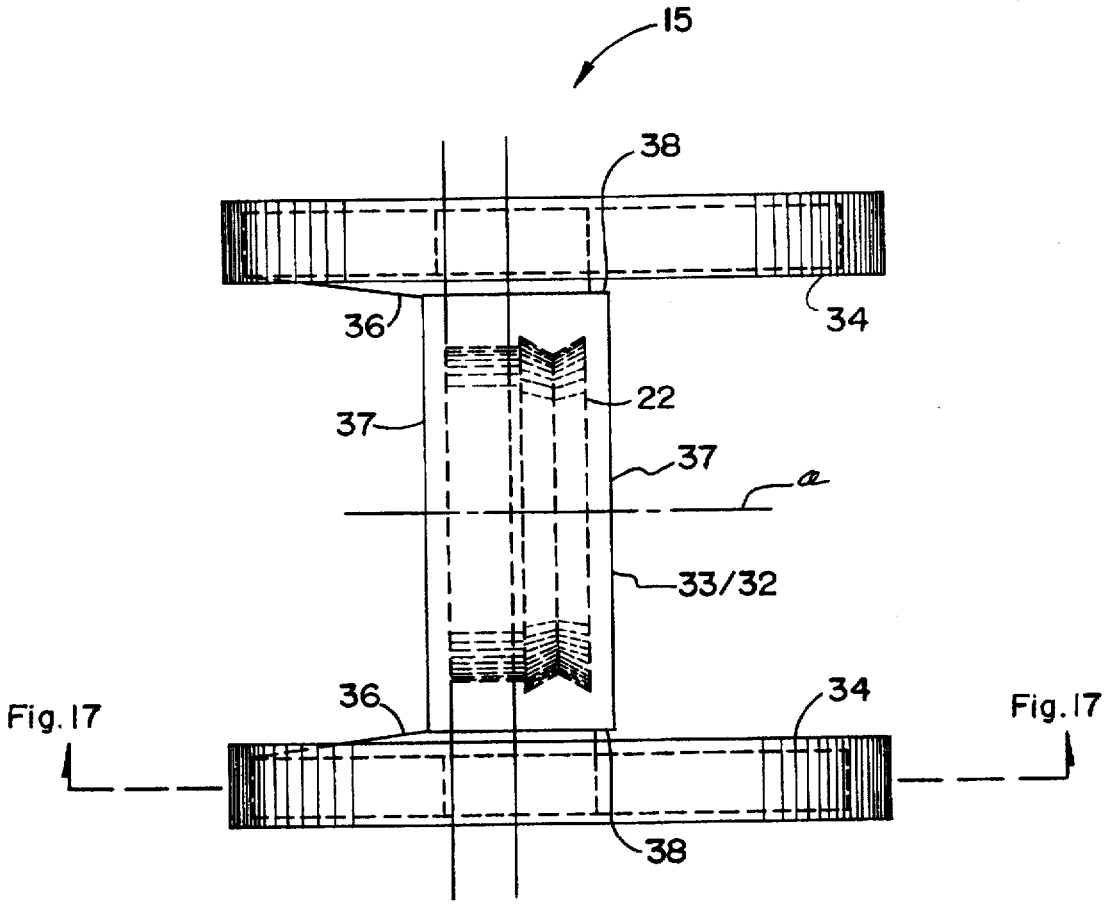
Figure 17:
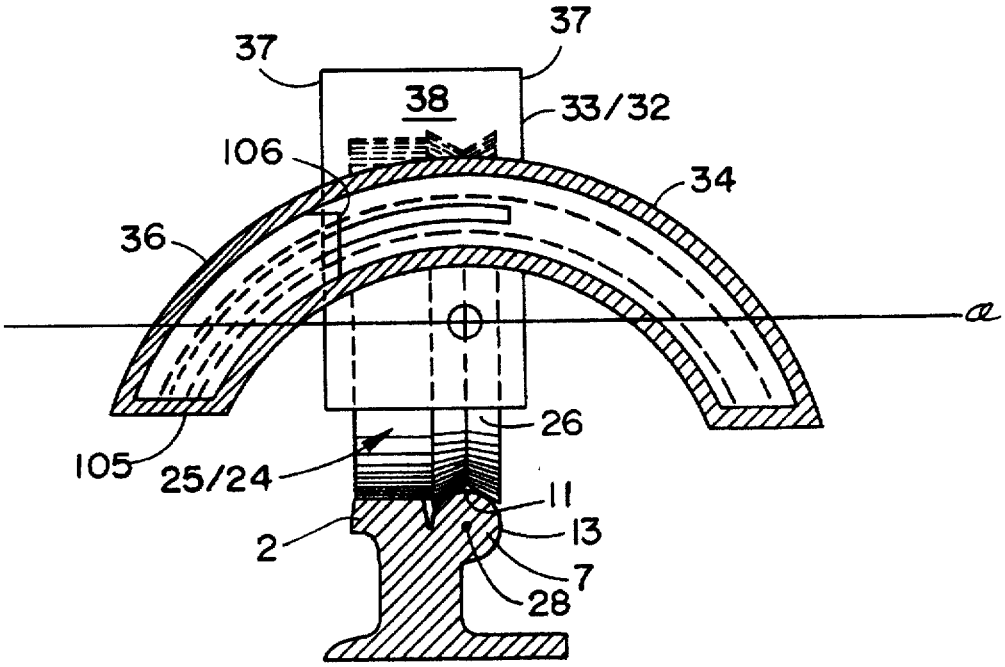
Figure 17A:
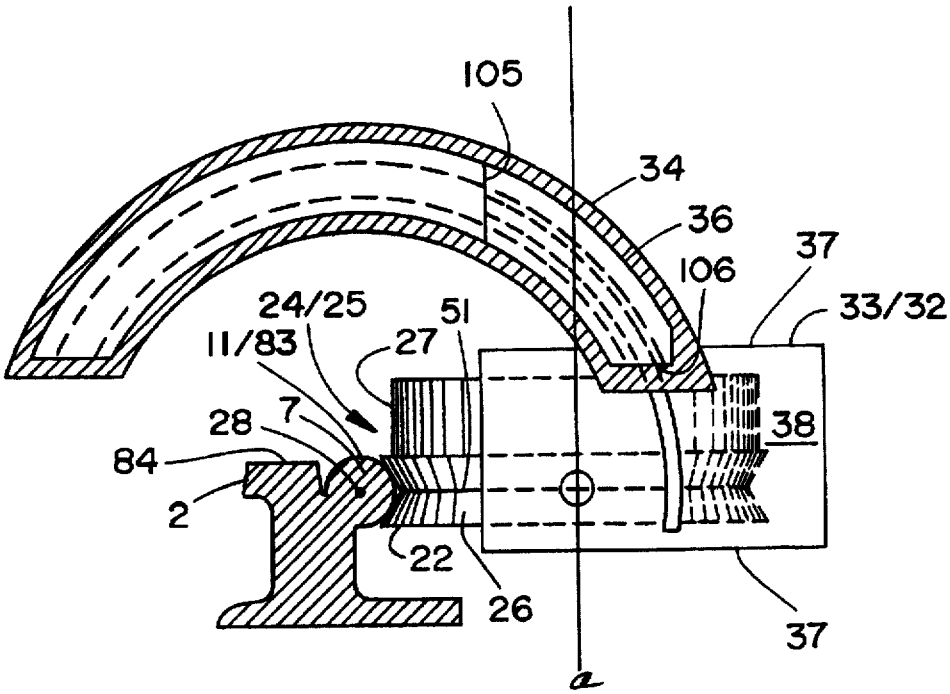
Figure 20:
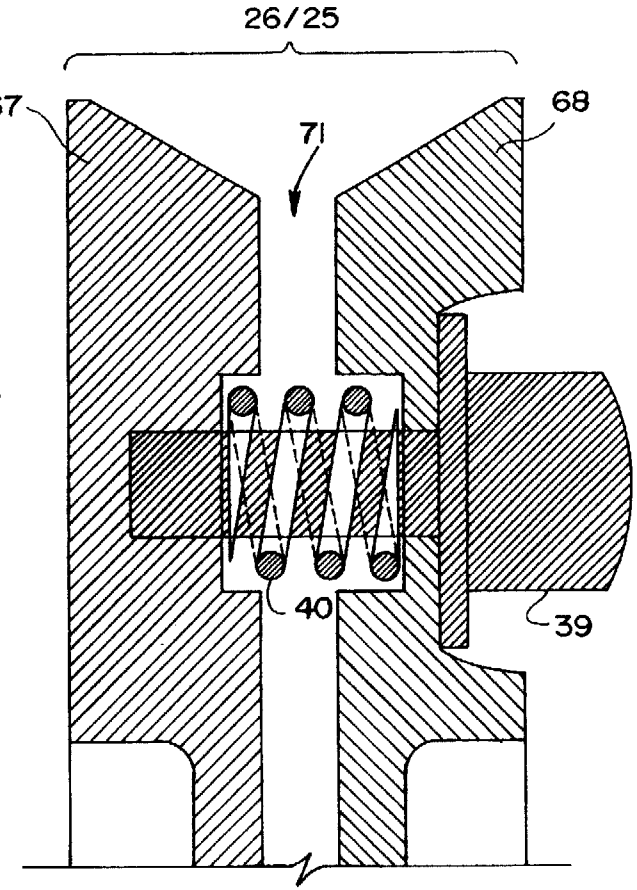
Figure 19:
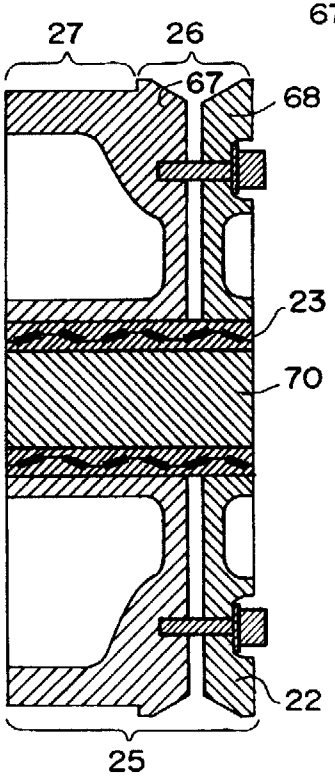
Figure 18:
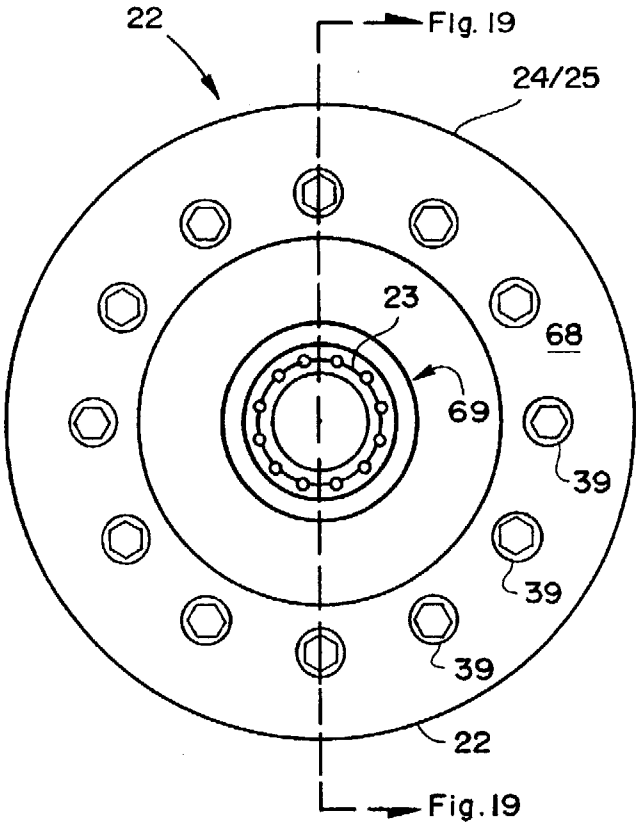
Figure 21:
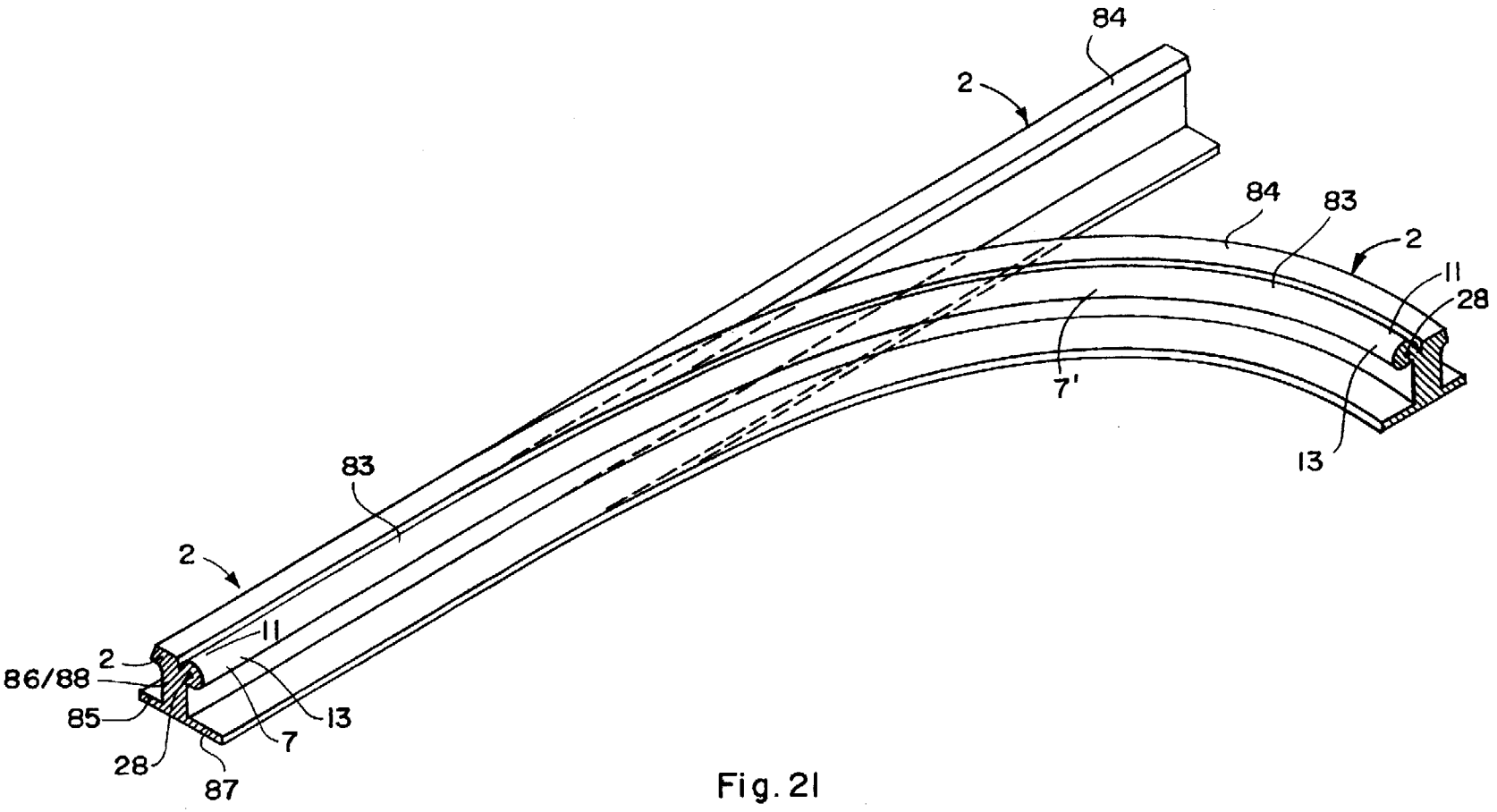
Figure 22:
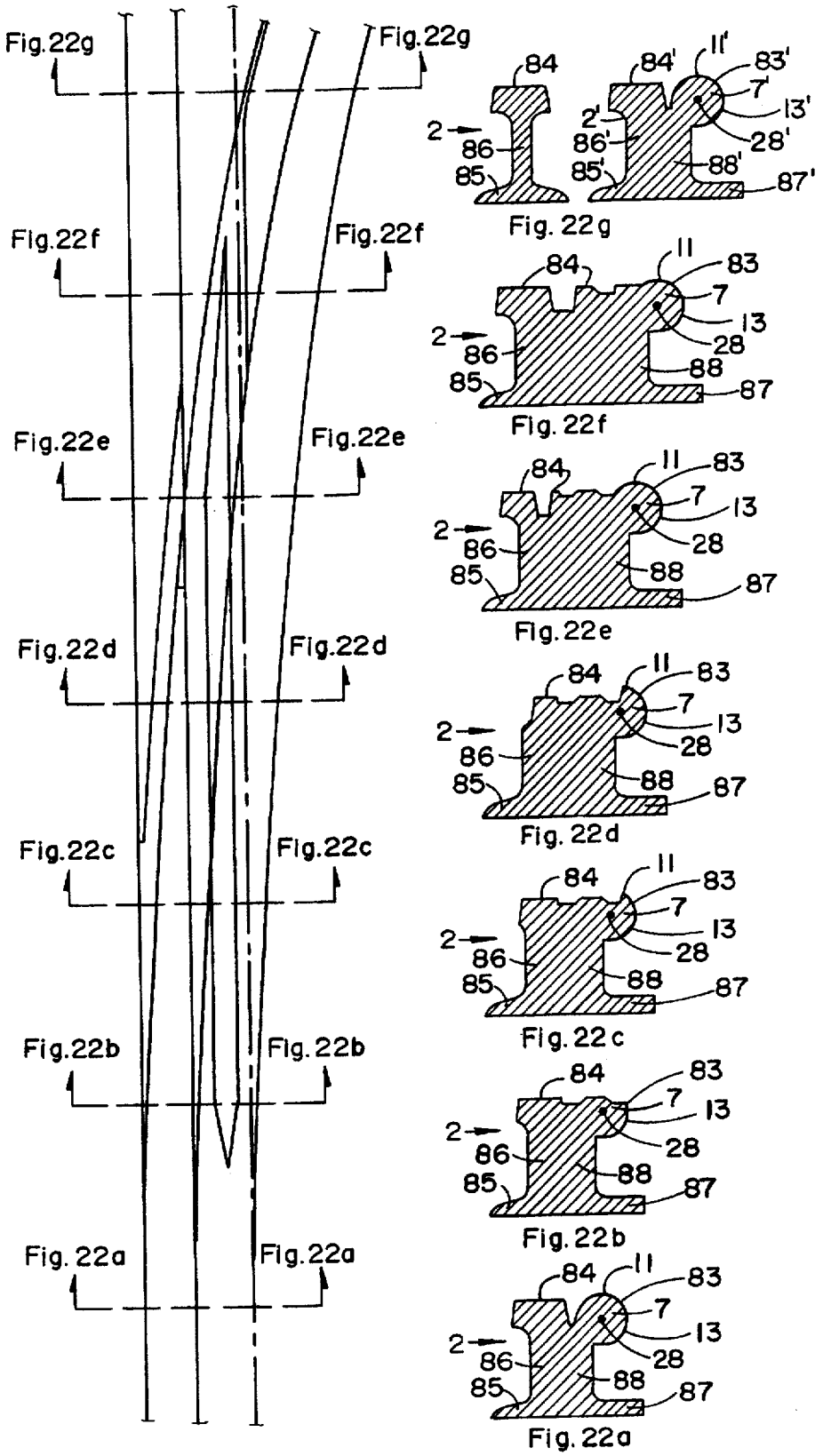
Figure 23A:
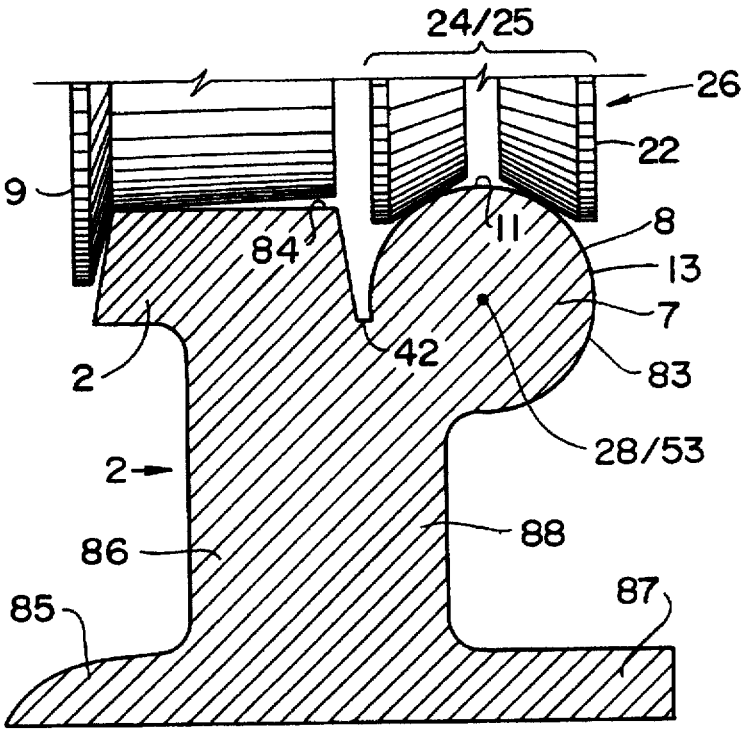
Figure 23B:
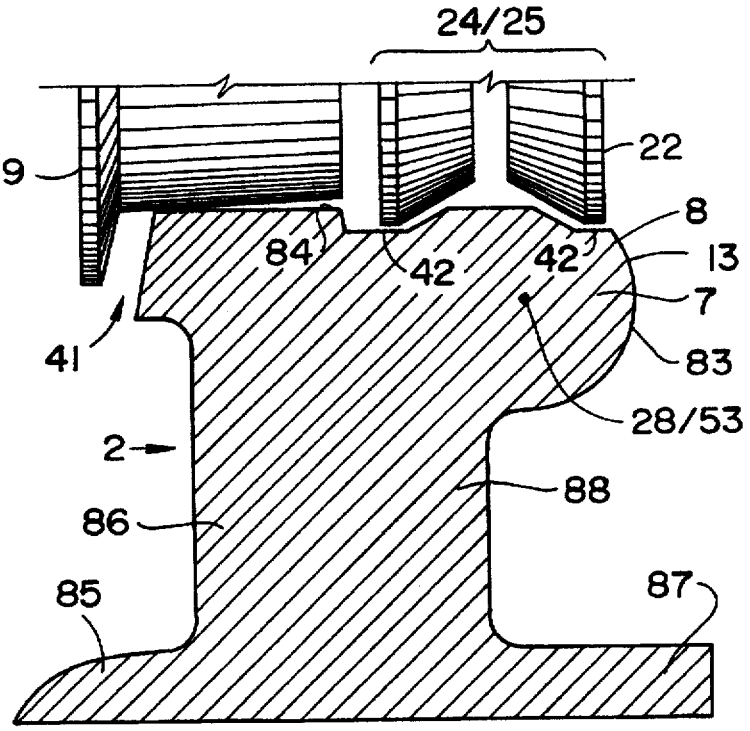
Figure 23C:
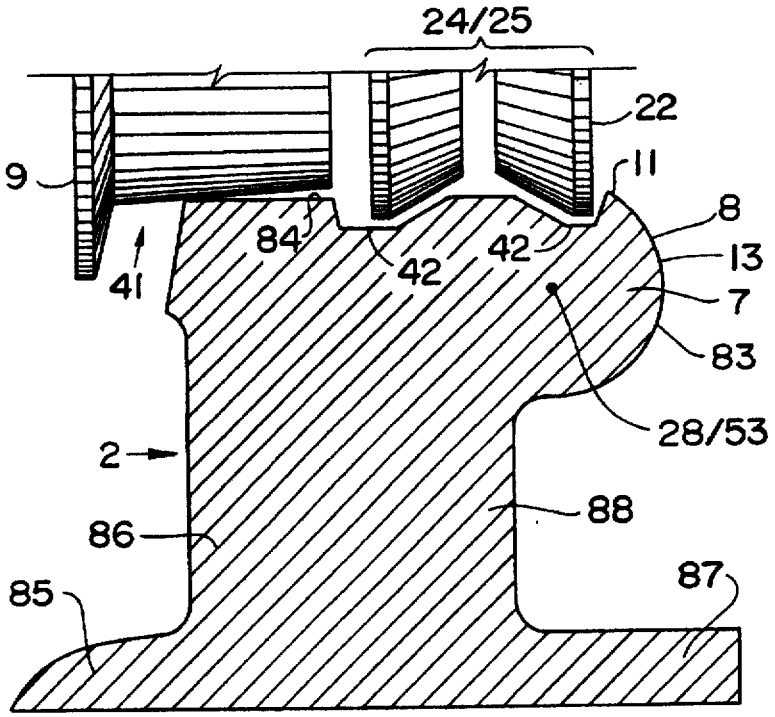
Figure 23D:
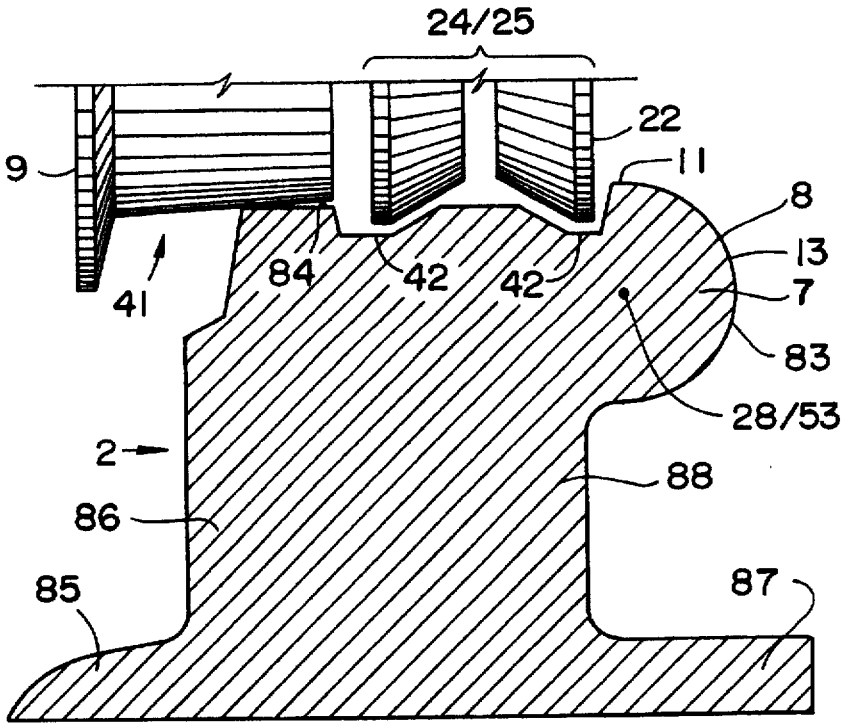
Figure 23E:
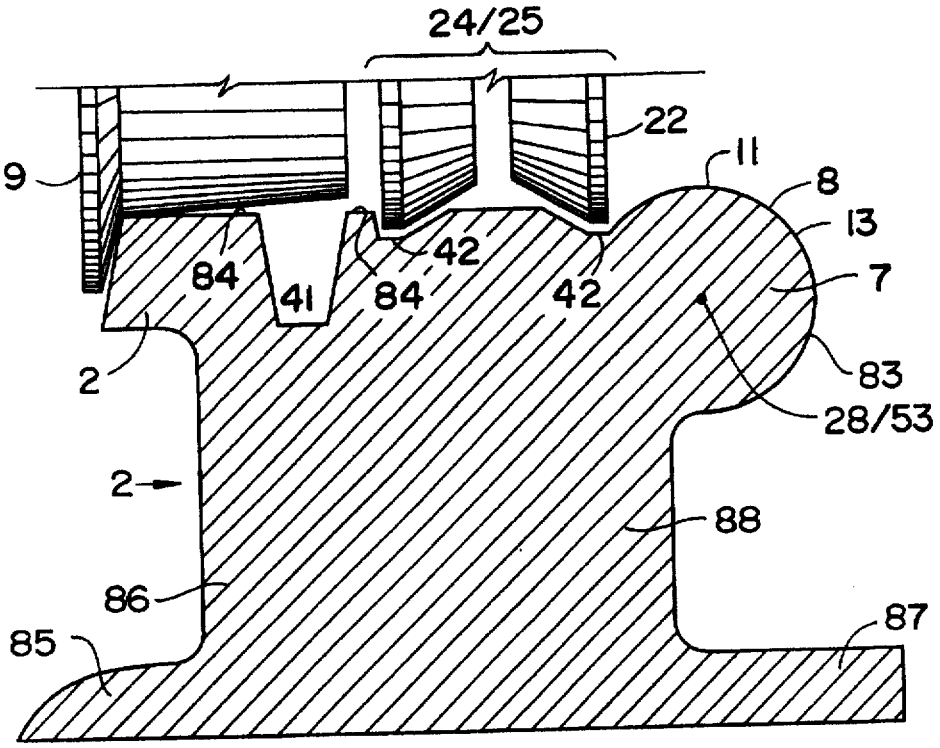
Figure 23F:
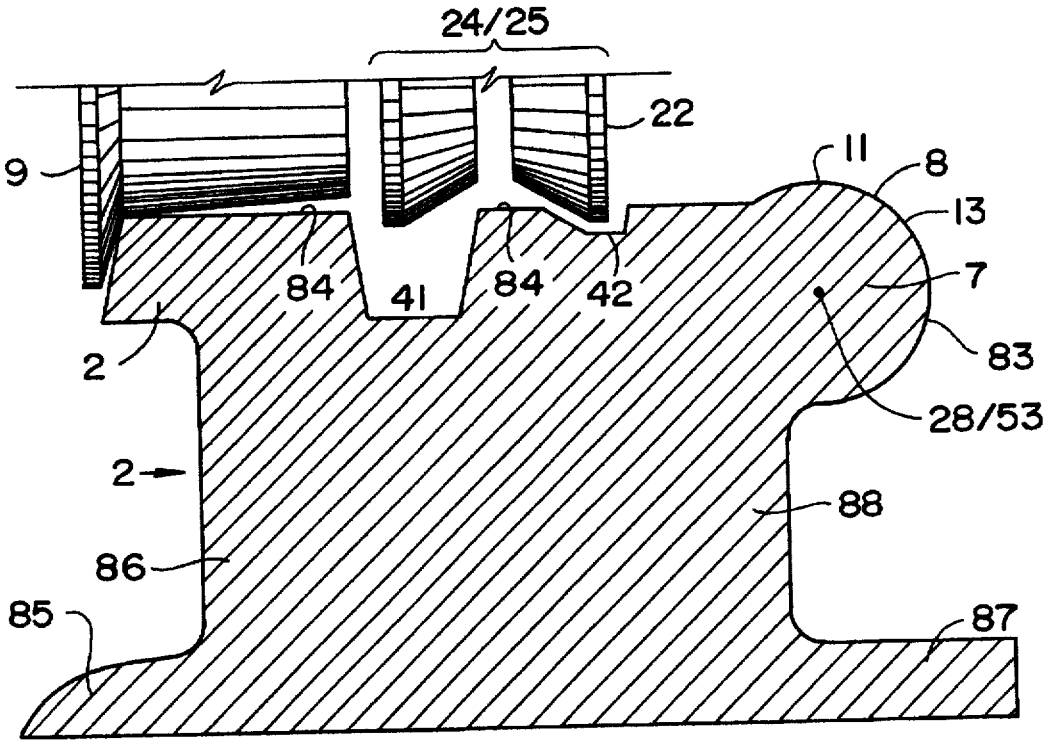
Figure 23G:
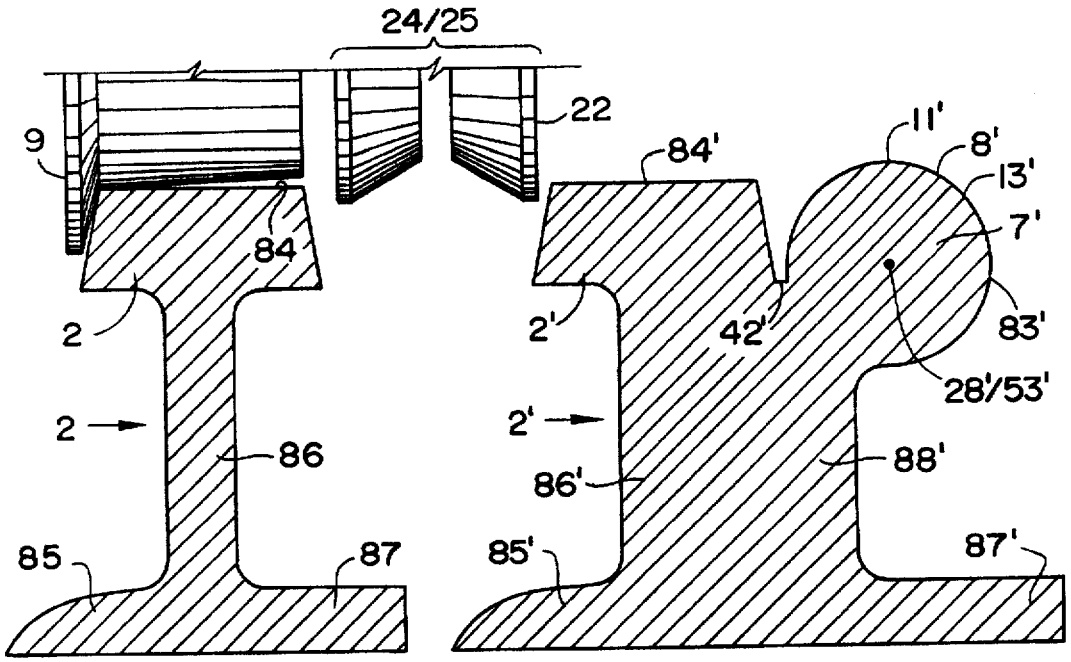
Figure 24A:
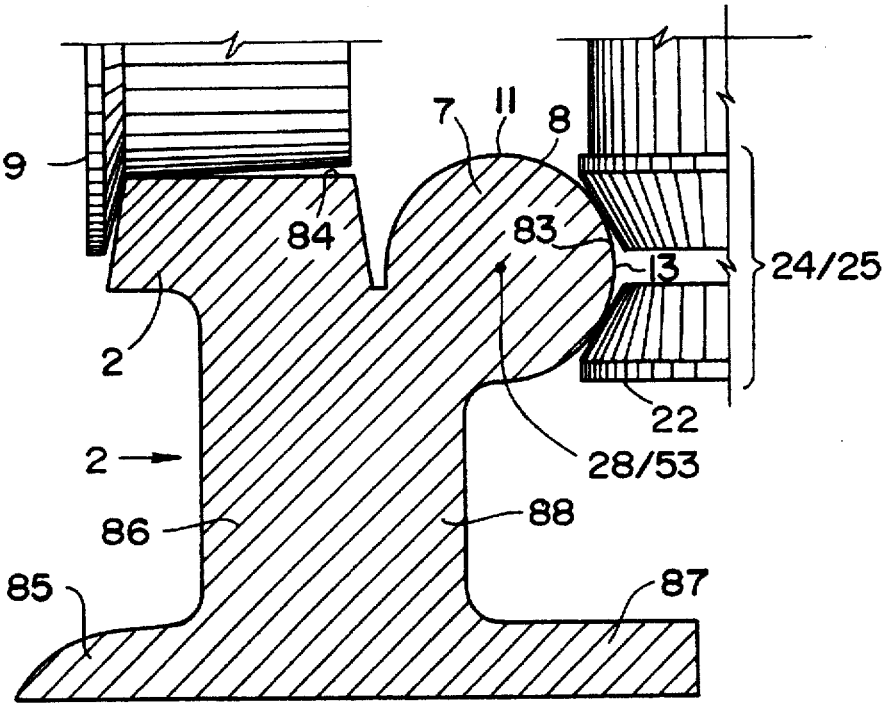
Figure 24B:
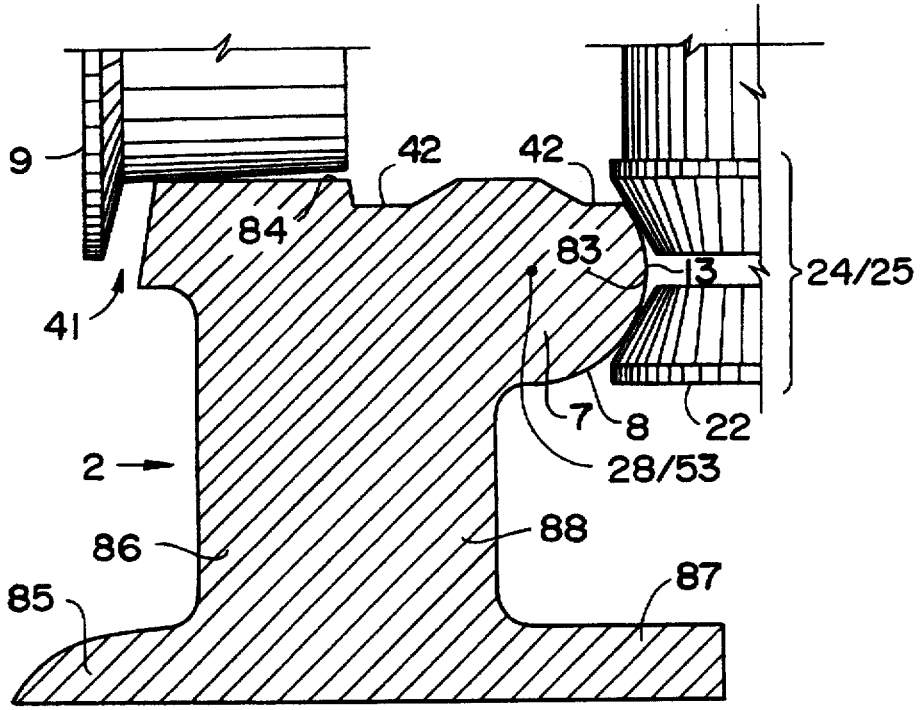
Figure 24C:
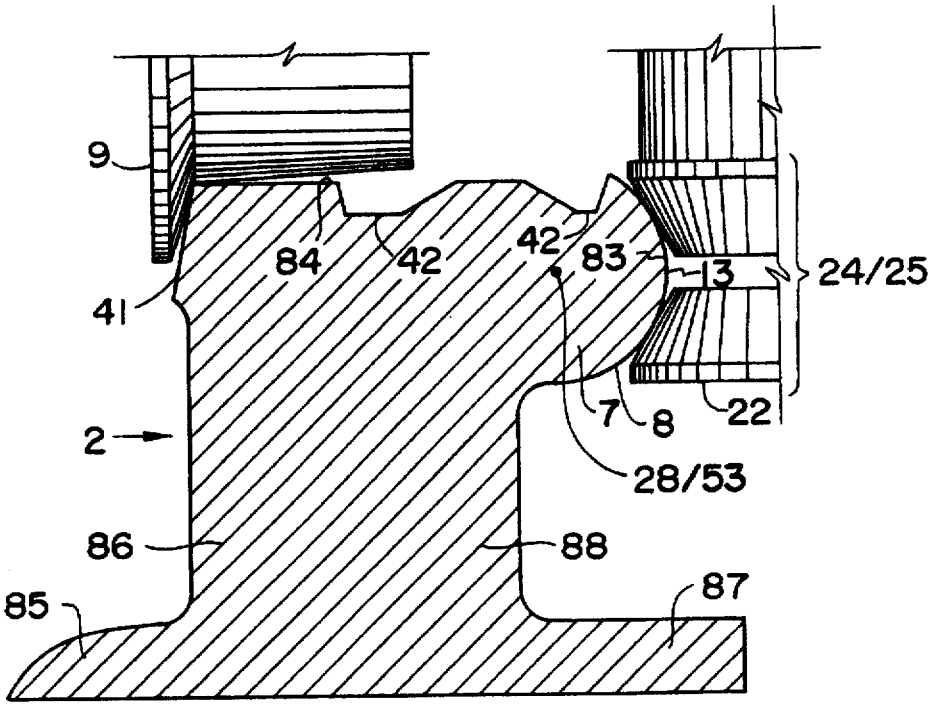
Figure 24D:
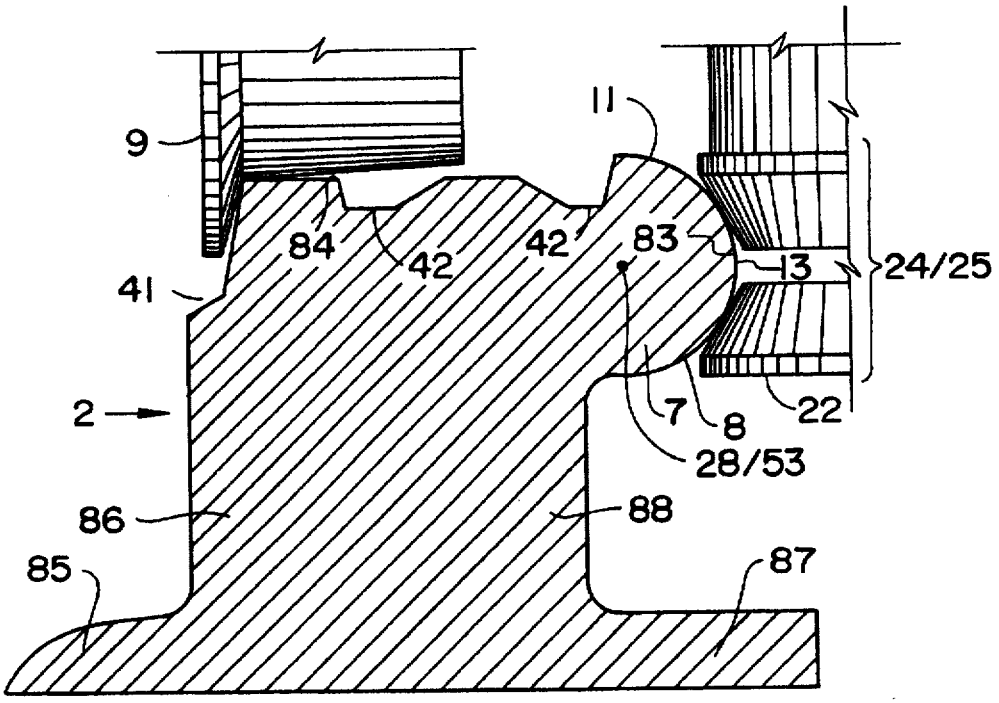
Figure 24E:
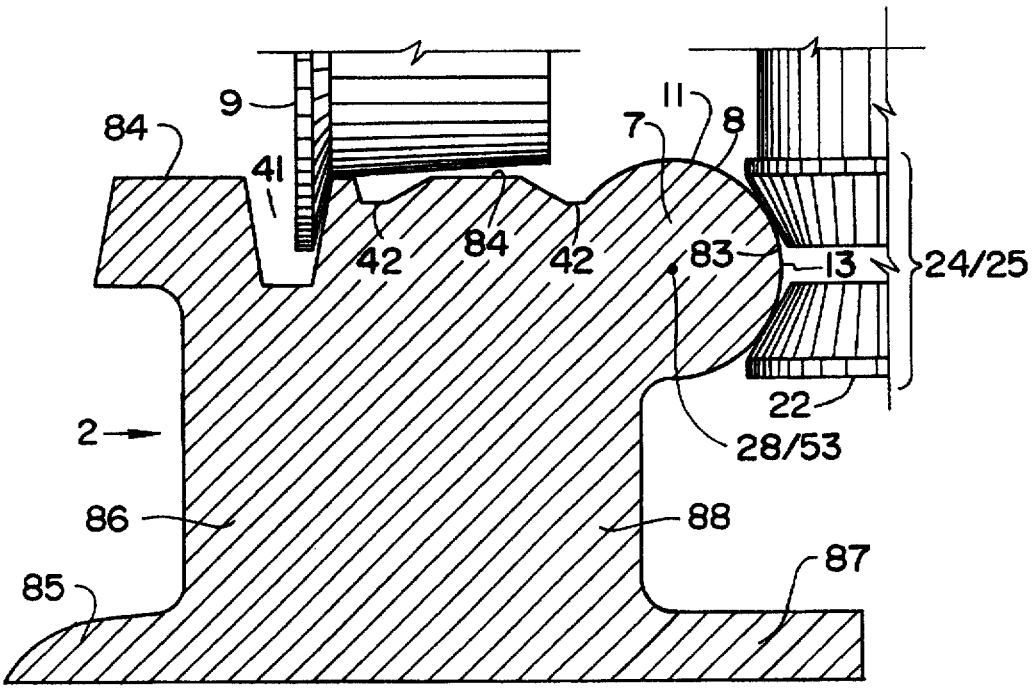
Figure 24F:
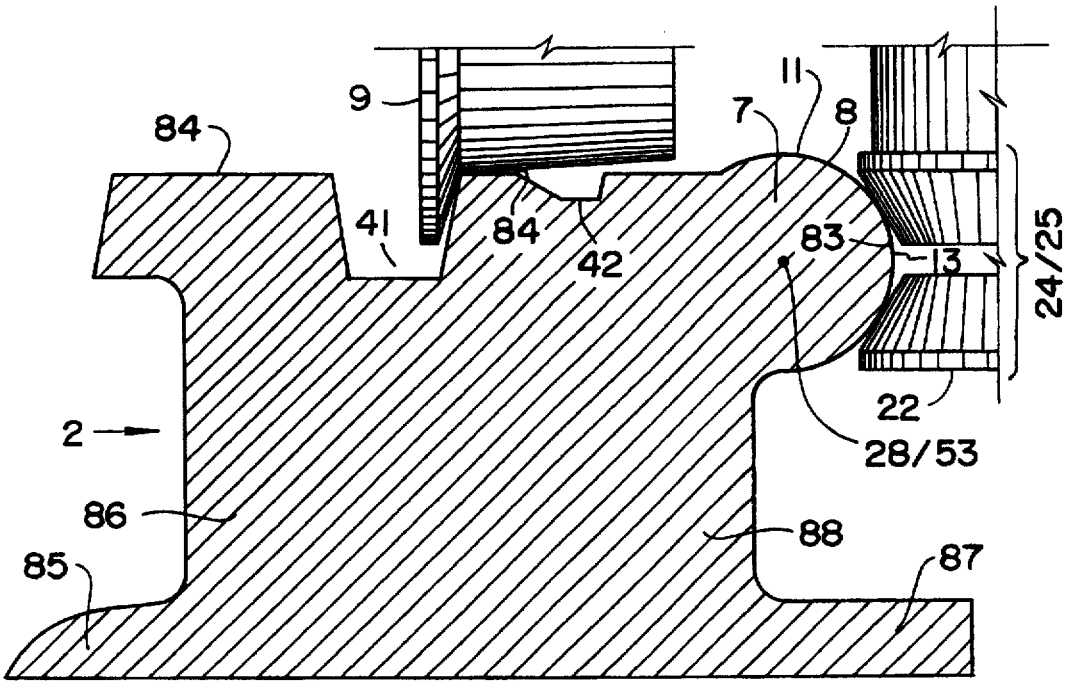
Figure 24G:
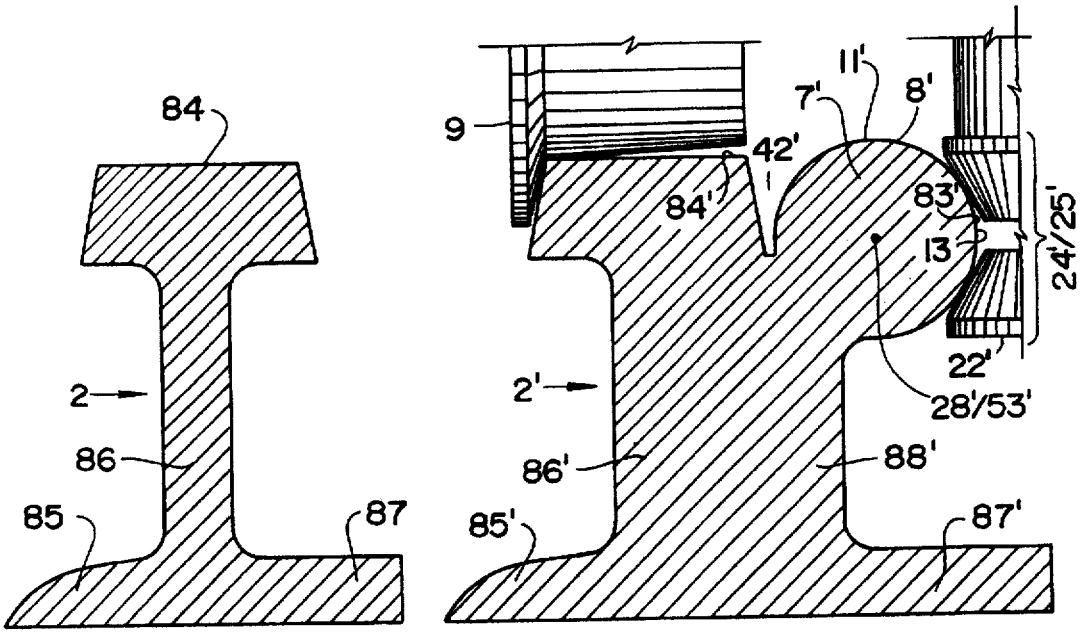
Figure 25:
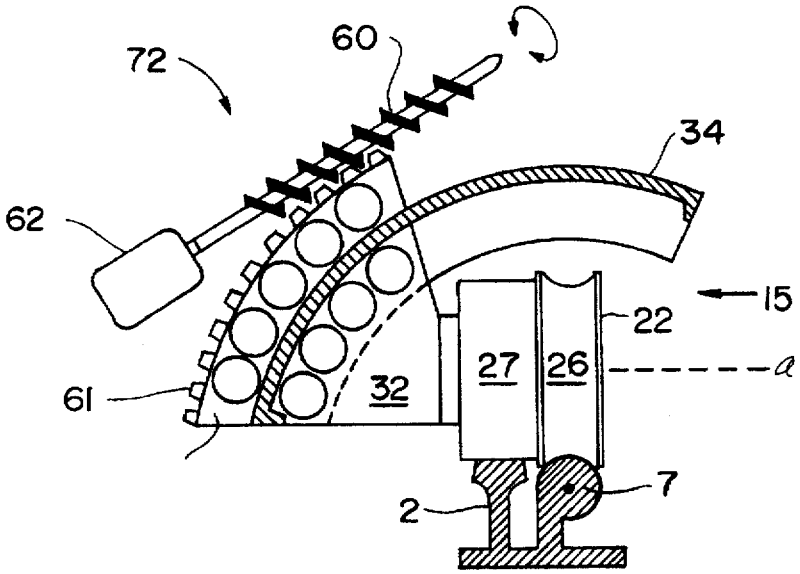
Figure 26:
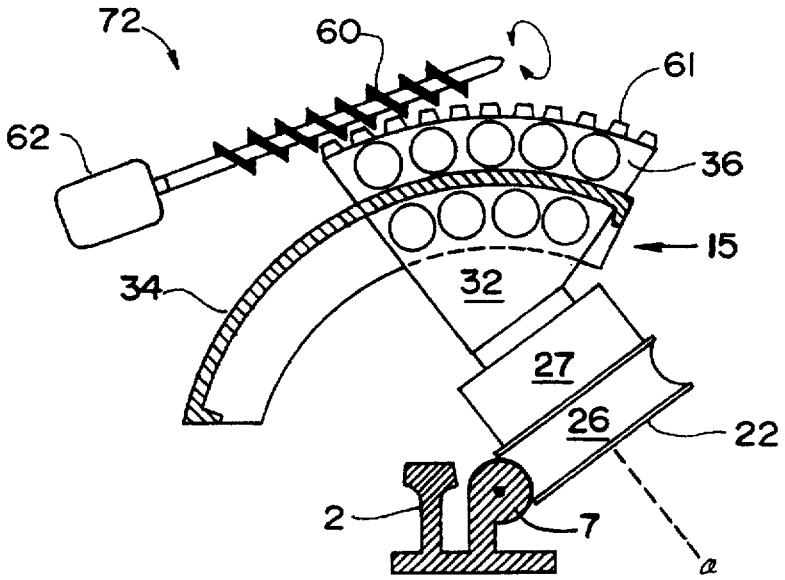
Figure 27:
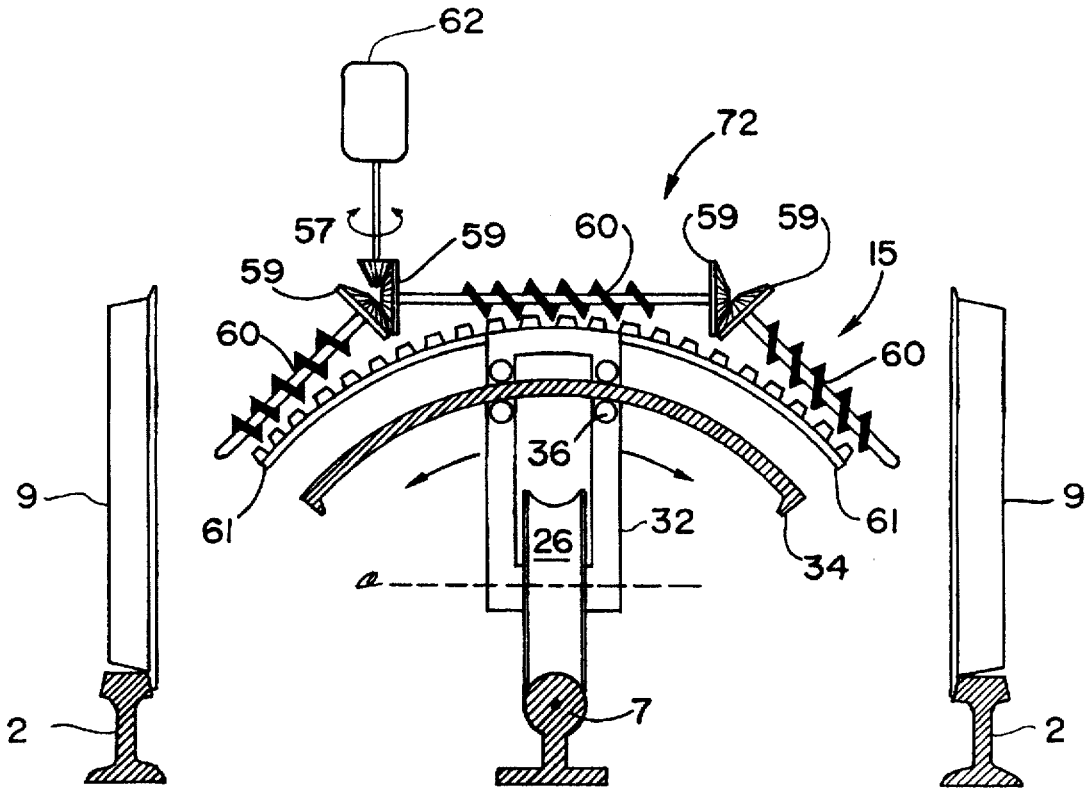

FIG. **6*a* is a side elevational view of the guide wheel of FIG. 6**;

FIG. 7 is a cross-sectional view of a main rail, guide rail, and a portion of a guide wheel of the present invention;

FIG. 7a is a cross-sectional view of a main rail, guide rail, and a portion of a composite guide wheel of the present invention;

FIG. 8 is a schematic top plan view of a branch section of a preferred embodiment of the railway track and railway vehicle of the present invention;

FIG. 9 is a top plan view of a railway vehicle comprising the guidance device of the present invention joined thereto;

FIG. 10 is an elevated side view of the railway vehicle of FIG. 9 positioned upon a track;

FIG. 11 is an end view of the railway vehicle of FIG. 1 with portions of the vehicle body removed for clarity;

FIG. 12 is a partial view of the preferred guidance device of the present invention with the main rail and guide rail shown in cross-section and the guide wheel shown in a vertical orientation;

FIG. 13 is a partial view of the preferred guidance device of the present invention with the main rail and guide rail shown in cross-section and the guide wheel shown in a horizontal orientation;

FIG. 14 is a schematic top-plan view of a preferred embodiment of the guidance device of the present invention with the guide wheel rotating about a substantially horizontal axis;

FIG. 15 is a schematic top plan view of the guidance device of FIG. 14 with the guide wheel rotating about a substantially vertical axis and the dampening springs and reaction frame removed for clarity;

FIG. 16 is a top plan view of a preferred pivoting member and guide wheel embodiment of the present invention with the guide wheel rotating about a substantially horizontal axis;

FIG. 17 is an elevational view of the pivoting member and guide wheel of FIG. 16 taken in the direction of travel with the guide wheel rotating about a substantially horizontal axis (the guide wheel is shown partially in phantom; the main rail, guide rail, and pivoting-member guide are shown in cross-section);

FIG. 17a is the same view as that of FIG. 18, however the guide wheel is shown rotating about a non-horizontal axis;

FIG. 18 is a side elevational view of an alternate guide wheel embodiment of the present invention;

FIG. 19 is a cross-sectional view of the guide wheel of FIG. 18 taken along section line 19—19;

FIG. 20 is a cross-sectional view of a portion of another alternate guide wheel embodiment of the present invention;

FIG. 21 is a perspective view of a section of one of the main rails and guide rail of the track of FIG. 3;

FIG. 22 is a schematic top plan view of the rail of FIG. 21;

FIGS. 22a through 22g are cross-sectional views of the rail of FIG. 22 taken along section lines a—a through g—g, respectively;

FIGS. 23a through 23g are cross-sectional views of the rail of FIG. 22 taken along section lines a—a through g—g, respectively, showing the position of a main wheel and guide wheel with the guide wheel in a vertical orientation;

FIGS. 24a through 24g are cross-sectional views of the rail of FIG. 22 taken along section lines a—a through g—g, respectively, showing the position of a main wheel and guide wheel with the guide wheel in a horizontal orientation;

FIG. 25 is an elevational view in the direction of travel, of an alternate embodiment of the guidance device of the present invention with the guide wheel rotating about a substantially horizontal axis;

FIG. 26 is an elevational view of the guidance device of FIG. 25 with the guide wheel rotating about a non-horizontal axis; and FIG. 27 is a front elevational view of an alternate embodiment of the guidance device and railway vehicle of the present invention wherein the guide rail is positioned between the main rails and the pivoting member and guide wheels are positioned between the main wheels of the vehicle.

DETAILED DESCRIPTION OF THE INVENTION

As used herein the term "track-following vehicle" shall refer to any vehicle having wheels which travel along a defined path such as a track or other fixed guideway. A "fixed guideway" or "track" is any extended bearing surface (or combination of bearing surfaces) external to a vehicle, which defines the path of travel of the vehicle.

As used herein the term "guidance device" shall refer to a means of directing a track-following vehicle to switch from one path of travel on a fixed guideway to an alternate path of travel on the fixed guideway, and may also refer to a means of assisting a track-following vehicle in negotiating changes in direction of a fixed guideway (e.g., track bends or curves).

The guidance device of the present invention may be used with many various track-following vehicles. A preferred example of a track-following vehicle is a railway vehicle. Therefore, the guidance device of the present invention shall be described with reference to a railway vehicle. However, it should be understood that the guidance device may be used with various track-following vehicles and its usage is not limited to railway vehicles.

A railway vehicle is a wheeled vehicle intended for use upon a track comprising parallel, elevated rails. Railway vehicles generally comprise a body wherein passengers travel and/or cargo is stored, a chassis to which the body is mounted, and a series of flanged main wheels which rotate about a horizontal axis and support the chassis and body upon the rails of the track. The chassis and main wheels are frequently referred to collectively as a "truck". The term "railway vehicle" shall be used herein to refer to a single truck, a single truck having a body mounted thereto, two or more trucks having a body mounted thereto, or any combination of trucks with bodies mounted thereto linked in a series and will also refer to vehicles which are motorized, i.e., self-propelled, and those which are non-motorized. A motorized vehicle is one having one or more drive motors connected to the axles to drive the main (wheels.

In a preferred embodiment the guidance device of the present invention will be used with a track or guideway comprising a pair of parallel main rails and at least one substantially circular guide rail associated with the main rails. FIG. 8 is a schematic top plan view of a preferred track embodiment at about a switching point 47. For purposes of illustration, curvatures may be exaggerated and distances foreshortened in FIG. 8. Referring to FIG. 8, the track 45 basically comprises a pair of parallel main rails 2 and at least one guide rail 7 joined to the main rail 2. As used herein, the term "joined" encompasses configurations whereby an element is directly secured to another element by affixing the element directly to the other element, and configurations whereby the element is indirectly secured to the other element by affixing the element to intermediate member(s) which in turn are affixed to the other element.

The guide rail will be longitudinally aligned with the main rails and may be continuous or intermittent. A continuous guide rail is one which extends substantially the entire length of the track, i.e., having no interruptions or having only brief interruptions in its length. An intermittent guide rail is one which is introduced into discrete portions of the track. For example, the guide rail may be introduced in the area of a branch or switch, so that the vehicle may be guided onto the branch track. The guide rail may also be introduced in the area of a curve in the track to assist in guiding the vehicle through the curve and to provide additional stability to the vehicle in a curve. In such an embodiment, the track will comprise at least one guide rail which will be joined to the curve-side main rail. As used herein the term "curve-side" shall refer to the side radially closest to the center of curvature of a curve in the track.

Although the track layout shown in FIG. 8 comprises one guide rail joined to the branch-side main rail, the track may comprise two guide rails associated with the main rails such that each main rail has a guide rail joined thereto.

A detailed perspective view of a main rail 2 and a guide rail 7 is shown in FIG. 21. For purposes of illustration, curvatures may be exaggerated and distances foreshortened in FIG. 21. Referring to FIG. 21, The main rail 2 provides support for the main wheels of the vehicle upon the track 45. The main rails are preferably of the type commonly used in the railway industry, and generally comprise a base 85, a bearing surface 84 upon which the main wheels ride, and a column 86 which joins the base 85 to the bearing surface 84 and supports the bearing surface 84 above the base 85.

The guide rail 7 guides the guide wheel 22 upon the track 45. Referring to FIG. 7, the guide rail 7 basically comprises a bearing surface 83, a base 87, and a column 88 which connects the bearing surface 83 to the base 87 and supports the bearing surface 83 above the base 87. It can be seen that the bearing surface 83 of the guide rail 7 is substantially circular when viewed in cross-section and comprises a top 11 and a side 13. The top 11 of the guide rail 7 and the side 13 of the guide rail 7 form a substantially circular arc 8 when the guide rail 7 is viewed in cross-section.

The top 11 of the guide rail 7 is that portion of the guide rail 7 which will be in facing relation with the guide wheel 22 when the guide wheel 22 is rotating about a substantially horizontal axis. The side 13 of the guide rail 7 is that portion of the guide rail which is most laterally outboard. As used herein the term "lateral" or "laterally" shall refer to the direction transverse to the direction of travel for the vehicle, i.e., perpendicular to the rails of the track. At least a portion of the side 13 of the guide rail 7 will be in facing relation with the guide wheel 22 when the guide wheel 22 is rotating about a non-horizontal axis. Preferably, the top 11 of the guide rail 7 is at an elevation substantially equal to the elevation of the bearing surface 84 of the main rail 2. The center 28 of the guide rail 7 is that point which is substantially equidistant from each point on the arc 8 of the guide rail when viewed in cross-section and is, therefore, the center of curvature of the substantially circular arc 8.

Referring to FIG. 8, the guide rail 7 will be located in at least the area of a switch 47 in the track 45. The switch 47 is an area where the track 45 leads off into two alternative directions thus defining divergent paths, i.e., a main track 46 and a branch track 44, to be followed by vehicles entering the switch 47. The main track 46 may be thought of as being substantially a continuation of the track 45 after the switching point 47. The branch track 44 diverges from the track 45 and the main track 46, and may be thought of as forming a new track 45' after leaving the switching point 47. The terms "switch" and "switching point" are used interchangeably herein, and generally describe the point at which the branch track 44 begins to diverge from the main track 46.

The guide rail 7 commences just up-track from the switching point 47 and is positioned on the branch-side of the track 45. The term "branch-side" is used herein as referring generally to the side of the track 45 from which the branch track 44 begins to diverge at a switch. The guide rail 7 of the track 45 continues through the switch to form the guide rail 7' of the branch track 44 such that the guide rail 7' of the branch tack 44 is a continuation of the guide rail 7 of the track 45.

It should be understood that the guide rail may be a separate rail indirectly affixed to the main rail, or the guide rail may be a separate rail directly affixed to the main rail. However, in a preferred embodiment such as is shown in FIG. 21, the guide rail is integral with the main rail. It should also be understood that although the guide rail 7 is shown as a solid rail, other embodiments may also be suitable, e.g., the guide rail may be hollow or in the form of a partial circle. For example, in areas of the track wherein the guide wheel is rotating about a horizontal axis and would never be pivoted to rotation about a non-horizontal axis, the bearing surface 83 of the guide rail 7 may comprise a top 11, and it would be unnecessary for the bearing surface 83 to comprise a side 13. Alternatively, in areas of the track wherein the guide wheel is rotating about a non-horizontal axis and would never be pivoted to rotation about a horizontal axis, the bearing surface 83 of the guide rail 7 may comprise a side 13, and it would be unnecessary for the bearing surface 83 to comprise a top 11.

FIG. 22 shows a schematic top view of a particularly preferred embodiment of the branch-side main rail 2 at a switching point 47 with corresponding cross-sectional views, a—a through g—g, shown in FIGS. 22*a* through 22*g*. For purposes of illustration, curvatures may be exaggerated and distances foreshortened in FIG. 22. Referring to FIG. 22*a*, a cross-sectional view taken along section line a—a, the arc 8 of the guide rail 7 forms almost a complete circle and has an arcuate top 11 and side 13. Referring to FIGS. 22*b* through 22*d*, a cross-sectional views taken along section lines b—b through d—d respectively, the main rail 2 begins to diverge to form a second main rail, or branch-side rail 2'. In FIGS. 22*b* through 22*d*, the top 11 of the arc 8 of the guide rail 7 has been substantially removed to provide a series of grooves 41, 42. Certain grooves 42 allow for passage of the guide wheel 22 while the guide wheel is in a vertical orientation, i.e., is rotating about a substantially horizontal axis. Other grooves 41 are provided to allow for the passage of the flanges of the main wheels when the vehicle is being directed toward the branch track 44. However, in FIGS. 22*b* through 22*d* the side 13 of the guide rail 7 is substantially arcuate and provides a bearing surface 83 which the guide wheel will contact when the guide wheel is in a non-vertical orientation, i.e., rotating about a non-horizontal axis, and the vehicle is turning toward the branch track. In FIGS. 22*e* and 22*f*, cross-sectional views taken along section lines e—e and f—f respectively, the branch-side rail 2' continues to diverge and the grooves 41, 42 continue to allow for passage of the guide wheel in a vertical orientation or passage of the main wheels when the vehicle is being directed toward the branch track. In FIG. 22*g*, a cross-sectional view taken along section line g—g, the branch-side rail 2' has completely diverged from the main rail 2. It can be seen that the main rail 2 comprises a main rail 2 and the branch-side rail 2' comprises a main rail 2' and a guide rail 7'. The guide rail 7' of the branch rail 2' is a continuation of the guide rail which began prior to the switching point.

The guidance device of the present invention basically comprises a guide wheel 22 which is complementary with the substantially circular guide rail 7, rotates about an axis, and is capable of pivoting about the guide rail from rotation about a substantially horizontal axis to rotation about a non-horizontal axis.

The guide wheel may comprise any structure capable of rotating uniformly about an axis of rotation. For example, the guide wheel may be a solid disk or a rigid circular ring connected by spokes to a hub. The guide wheel 22 rides upon the substantially circular guide rail 7 and is complementary with the guide rail 7. As used herein the term "complementary guide wheel" shall refer to a guide wheel having at least a portion of its circumference which is indented, cupped, concave, or the like when viewed in cross-section and which allows the guide wheel to pivot about the circular guide rail from rotation about a horizontal axis to rotation about a non-horizontal axis while maintaining a substantially radial orientation with respect to the center of the circular guide rail.

While the vehicle is engaged in normal travel upon the rail, i.e., travel not involving a curve in the track or a branch in the track, the guide wheels will preferably rotate about a substantially horizontal axis.

In about the area of a switch 47 in the track, one of the guide wheels may be pivoted about the guide rail 7 to cause the vehicle to take a selected path at the switch 47. If the vehicle is to turn to the left at the switch, the guide wheel on the left side of the vehicle Will be pivoted outward about the guide rail on the left side of the track. If the vehicle is to turn to the right at the switch, the guide wheel on the right side of the vehicle will be pivoted outward about the guide rail on the right side of the track. In about the area of a curve in the track, one of the guide wheels may be pivoted about the guide rail to provide lateral stability to the vehicle and to guide the vehicle through the curve. The circular shape of the guide rail allows the complementary guide wheel to move or pivot smoothly from rotation about a horizontal axis to rotation about a non-horizontal horizontal axis while maintaining a substantially radial orientation with respect to the center of the guide rail.

When the guide wheel is pivoted about the guide rail to a rotation about a non-horizontal axis, the guide rail will impart a horizontal vector force to the guide wheel which will guide the guide wheel onto the branch track 44 at the switch 47. Accordingly, the vehicle will be guided on to a selected path at a switch 47 in the track 45.

The guide wheels may be made from any materials which are strong enough to bear the forces of the vehicle in a turn. Accordingly, the guide wheels may be made from materials similar to those used for the main wheels 9. The guide wheels may also be made from non-metallic materials such as hard rubber or polymeric materials. Preferably, the guide wheel will be made from a material which is slightly softer than the guide rail and therefore will not quickly wear-out the guide rail.

Figure 6A:
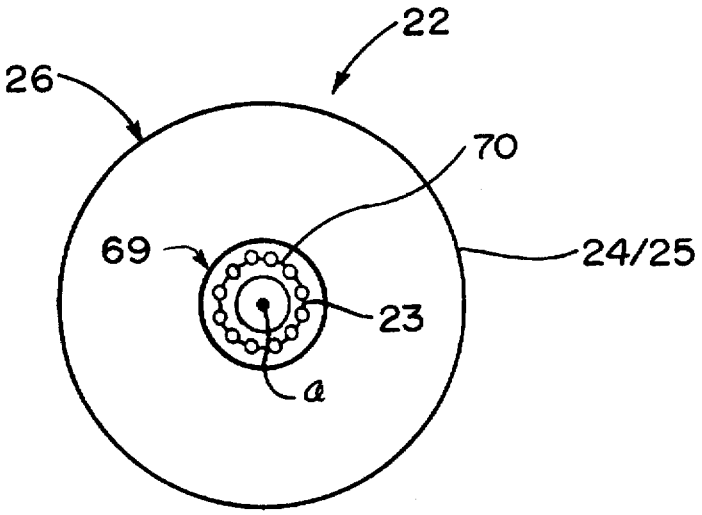

A preferred embodiment of the guide wheel 22 of the present invention is shown in detail in FIGS. 6 and 6*a*. Referring to FIGS. 6 and 6A the guide wheel 22 comprises an axis of rotation α which passes perpendicularly through the center 69 of the guide wheel 22, and a circumference 24 comprising a riding surface 25. The guide wheel 22 is designed to turn about an axle 70 which passes through the center 69 of the guide wheel 22. The guide wheel preferably also comprises a bearing member 23 disposed between the axle 70 and the center 69 of the guide wheel.

The guide wheel 22 is mounted on an axle 70 which passes through the center 69 of the guide wheel 22 and will be firmly secured to the pivoting member frame 32. The guide wheel 22 is mounted to the axle 70 by means of a bearing member 23 which allows the guide wheel 22 to rotate freely about the axle 70 with a minimum of friction and wear. Because the guide wheel will pivot about horizontal and non-horizontal axes of rotation, the bearing member 23 will preferably provide protection from friction and wear with both radial and axial forces. A suitable bearing member is a rolling contact bearing such as ball bearings and roller bearings. In a particularly preferred embodiment the bearing members 23 will comprise opposed taper roller bearings. However, other suitable bearing members will be apparent to one skilled in the art.

The riding surface 25 comprises a guide portion 26 and in a preferred embodiment will also comprise a support portion 27. The guide portion 26 is that portion of the guide wheel 22 which will contact the bearing surface 83 of the guide rail 7. The guide portion 26 of the guide wheel 22 is that portion of the guide wheel 22 which is indented, cupped, concave, or the like and is, therefore, substantially complementary with the guide rail 7. Referring to FIG. 6, it can be seen that the guide portion 26 of the riding surface 25 comprises an inner guide edge 50, an outer guide edge 52, and a median 51 located between the inner guide edge 50 and outer guide edge 52. The median 51 is substantially equidistant from the inner guide edge 50 and outer guide edge 52 throughout the circumference of the guide wheel 22.

The radius of the guide wheel at the outer guide edge 52 (i.e., the distance from the axis of rotation a to α point on the outer guide edge 52) is greater than the radius of the guide wheel at the median 51 (i.e., the distance from the axis of rotation α to a point on the median 51 of the guide portion 26). Preferably, the radius of the guide wheel at the inner guide edge 50 (i.e., the distance from the axis of rotation α to a point on the inner guide edge 50) is also greater than the radius of the guide wheel at the median 51.

Although in the preferred embodiments of the guide wheel shown herein, the radius of the guide wheel 22 at the inner guide edge 50 is greater than the radius of the guide wheel 22 at the median 51 and is substantially equal to the radius of the guide wheel 22 at the outer guide edge 52, embodiments wherein the radius of the guide wheel 22 at the inner guide edge 50 and the radius of the guide wheel 22 at the outer guide edge 52 are not equal, may also be suitable and are also contemplated.

Associated with the guide portion 26 of each guide wheel 22 is a pivot point 53. Referring to FIGS. 7 and 7*a*, the "pivot point" of the guide wheel 22 may be thought of as the point about which the guide wheel pivots, and is located at about the center 28 of the guide rail 7. The pivot point 53 is located by viewing in the direction of travel a cross-section of the guide rail 7 and guide wheel 22 taken perpendicular to the main rail 2 such as is shown in FIGS. 7 and 7*a*. The "direction of travel" is the direction parallel to the main rails 2 of the track 45. The centerpoint 28 of the guide rail 7 is that point which is substantially equidistant from each point on the arc 8 of the guide rail 7.

It can be seen that the guide wheel shown in FIG. 6, has a guide portion 26 which is substantially V-shaped when viewed in the direction of travel or in cross-section. The V-shape of the guide portion 26 is complementary with the substantially circular guide rail 7. In a particularly preferred guide wheel embodiment of the present invention, shown in FIG. 7, the guide portion 26 will be substantially arcuate when viewed in cross-section and forms a substantially circular arc which is complementary with the arc of the guide rail 7.

In alternate guide wheel embodiments of the present invention, shown in FIGS. 18, 19, and 20, the guide portion 26 of the guide wheel 22 is a composite. Referring to FIG. 20, a cross-sectional view of a portion of a guide wheel 22 having composite guide portion 26, it can be seen that the guide portion 26 comprises an inboard half 67 and an outboard half 68 which are held together by a series of fastening members 39. The circumference of the inboard half 67 and the circumference of the outboard half 68 are each beveled such that when the inboard half 67 and the outboard half 68 are joined in facing relation the resultant composite guide portion 26 is substantially V-shaped. The inboard half 67 and outboard half 68 are preferably dynamically held together by means of springs 40 which allow the two halves 67, 68 to move relative to each other in a direction parallel to the axis of rotation α of the guide wheel 22. Although the springs 40 are shown in FIG. 20 as pushing the two halves 67, 68 apart, the springs 40 may also be arranged such that they push the two halves 67, 68 together. The ability of the two halves 67, 68 to move relative to each other, allows the guide portion 26 to compensate for wear and/or irregularities in the guide rails of the track. The alternate embodiment of FIG. 19 is similar to that shown in FIG. 20, however, the guide wheel shown in FIG. 19 additionally comprises a support portion 27 which is joined to the inboard half 67 of the composite guide portion 26. FIG. 19 shows the support portion 27 as being integral with the guide portion 26. However, the support portion 27 and guide portion 26 may also be separate elements affixed indirectly to each other or separate elements affixed directly to each other.

FIGS. 23*a*–23*g* show the position of the main wheel 9 on the main rail 2 and the position of the guide wheel 22 on the guide rail 7 as the guide wheel 22 passes through the switch in a substantially vertical orientation. The guide wheel embodiment shown in FIGS. 23*a*–23*g* is a composite guide wheel comprising a support portion which, for purposes of clarity, is not shown.

Referring to FIG. 23*a* through 23*g*, it can be seen that when the axis of rotation α of the guide wheel 22 is substantially horizontal, the guide portion 26 of the guide wheel 22 is in facing relation with the top 11 of the guide rail 7. When the guide wheel 22 is in facing relation with the top 11 of the guide rail 7, the major vector forces between the guide wheel 22 and the guide rail 7 are oriented substantially vertically.

FIGS. 24*a*–24*g* show the position of the main wheel 9 on the main rail 2 and the position of the guide wheel 22 on the guide rail 7 as the guide wheel 22 is guided onto the branch track. The guide wheel embodiment shown in FIGS. 24*a*–24*g* comprises a guide portion 26 and a support portion 27.

When the guide wheel 22 is rotating about a non-horizontal axis as shown in FIGS. 24*a* through 24*g*, at least a portion of the guide portion 26 of the guide wheel 22 is in facing relation with at least a portion of the outboard side 13 of the guide rail 7. When a portion of the guide portion is in facing relation with the side 13 of the guide rail 7, horizontal vector forces are imparted to the guide wheel causing the guide wheel to follow the guide rail and causing the vehicle 3 to be guided onto the branch track.

In a preferred embodiment of the present invention, the riding surface 25 of the guide wheel 22 will additionally comprise a support portion 27. The support portion 27 is any portion of the riding surface which is intended to contact the main rail 2 and keeps the guide wheel 22 in continuous rotation about the axis of rotation α while the vehicle 3 is moving. The support portion 27 will be joined to the guide portion 26 and will be positioned laterally inboard of the guide portion 26 when the guide wheel is rotating about a substantially horizontal axis. The support portion 27 of the guide wheel will be aligned with the main rail 2 and the bottom of the circumference of the support portion 27 will be at an elevation substantially equal to the main rail 2 when the guide wheel is rotating about a substantially horizontal axis of rotation α. Accordingly, at least a portion of the support portion will be longitudinally aligned with the main wheels in the direction of travel of the vehicle 3. The support portion 27 may be flanged or may be flange-less. A guide wheel having a support portion is particularly useful with track arrangements wherein the guide rail is not continuous, i.e., intermittent.

Although the support portion of the guide wheel may provide support for the guide wheel, pivoting member, and/or vehicle, preferably the guide wheels are mounted in such a way that the support portion rests lightly upon the main rail, providing just enough contact between the support portion 27 and the main rail 2 so that the guide wheel is kept rotating at running speed when the vehicle is in motion.

The pivoting member 15 is any structure which allows the guide wheel to pivot outwardly about the guide rail from rotation about a substantially horizontal axis to rotation about a non-horizontal axis. Various means of pivoting the guide wheel about the guide rail will be apparent to those skilled in the art. The pivoting member embodiments shown herein are illustrative and not intended to limit the scope of the invention.

FIG. 16 is a top plan view of a preferred pivoting member embodiment of the present invention. Referring to FIG. 16, the pivoting member 15 will basically comprise a frame 32 to which the guide wheel 22 is mounted for rotation, a guide 34, and a guide follower 36 joined to the frame 32. The guide 34 will be joined to the vehicle and will preferably be joined to the chassis 19 of the truck 18.

The frame 32 is any structure to which the guide wheel 22 can be mounted for rotation and which is capable of supporting the guide wheel 22 in a horizontal or non-horizontal rotation. Referring to FIG. 16, the frame 32 comprises a wheel housing 33 comprising a pair of longitudinal sides 37 and a pair of transverse ends 38. The guide wheel 22 is mounted between the longitudinal sides 37 of the wheel housing 33.

Joined to each of the transverse ends 38 of the frame 32 is a guide follower 36 which follows the guide 34. The guide 34 and guide-follower 36 function to move the frame 32 and guide wheel 22 about the guide rail 7 while maintaining the guide wheel 22 in a radial orientation relative to the centerpoint 28 of the guide rail 7. The guide 34 and guide-follower 36 must be capable of moving the frame 32 and guide wheel 22 throughout the guide wheel's range of movement from rotation about a horizontal axis to rotation about a non-horizontal axis while the vehicle is moving upon the rails. Referring to FIG. 17 and 17*a*, the guide 34 is preferably arcuate and is mounted to the vehicle 3 such that the center of curvature is the arcuate guide is located at about the center 28 of the guide rail 7.

The guide follower 36 will slide freely within the guide 34 and in a preferred embodiment will be somewhat arcuate.

The ends 105, 106 of the arcuate guide follower 36 will preferably serve to stop the lateral movement of the guide wheel at a desired position.

Associated with the pivoting member is a drive member. The drive member is any means of applying a vector force to the pivoting-member frame such that the guide wheel will pivot about the guide rail. The drive member may be controlled by any means known in the art. The drive member is preferably controlled by an operator onboard the vehicle. FIGS. 12 through 15 show a preferred embodiment of the pivoting member and drive member of the present invention.

The drive member should be capable of moving the pivoting-member frame with the guide wheel mounted thereto from a first position wherein the guide wheel rotates about a substantially horizontal axis to a second position wherein the guide wheel rotates about a non-horizontal axis while keeping the guide wheel in a substantially radial orientation relative to the centerpoint of the guide rail and maintaining contact between the guide wheel and the guide rail.

The drive member should be sufficiently strong and stable to accomplish the arcuate movement of the guide wheel and to keep the guide wheel in contact with the guide rail while being subjected to the normal operating conditions of the vehicle. Suitable drive members may include hydraulically powered rams, electric motors, or the like.

Preferably the drive member will comprise one or more double-acting hydraulic rams, i.e., rams wherein pressurized fluid is used to extend and retract the piston. In a preferred embodiment shown in FIGS. 12 through 15, the drive member 72 for each pivoting member 15 will comprise a series of four double-acting hydraulic rams 74, 75. The hydraulic rams 74, 75 are powered by a pump (not shown herein) which is preferably controlled by an operator onboard the vehicle.

Referring to FIGS. 9 through 15 in detail, each ram 74, 75 comprises a body or cylinder 48 and an arm 49. Referring to FIG. 14, each of the cylinders 48 is dynamically joined at about its midpoint to the vehicle by means of a dynamic arm 31. Each of the dynamic arms 31 is pivotally connected at its base to a carriage member 65 through a series of brackets 80 Associated with each of the dynamic arms 31 are dampening springs 82. The dynamic arms 31 and dampening springs 82 allow the hydraulic rams 74, 75 to absorb some of the forces encountered during operation of the vehicle without effecting the operation of the hydraulic rams 74, 75.

The dampening springs 82 are provided with limit stops 79 which limit the elongation of the dampening springs 82 in situations such as when the guide wheel 22 is pivoted to rotate about a non-horizontal axis and the guide wheel 22 is not supported vertically by the main rail 9 or guide rail 7. Although not shown, limit stops may also be provided to the lower pair of dampening springs.

The wheel housing 33 comprises a pair of end brackets 29 joined to the transverse ends 38 and a pair of side brackets 30 joined to the inboard longitudinal side 37. It can be seen that the distal end of the hydraulic arm 49 of the two outer rams 75 are pivotally joined to the end brackets 29 of the wheel housing 33 and the distal end of the hydraulic arm 49 of the two inner rams 74 are pivotally joined to the side brackets 30 of the wheel housing 33.

When the rams 74, 75 are activated the arms 49 extend from the bodies 48 and apply a force to the wheel housing 33. The force causes the frame 32 and wheel housing 33 to move laterally outward causing the guide followers 36 to follow the path of travel through the arcuate guides 34. Accordingly, the guide wheel 22 is pivoted to a position wherein the axis of rotation is non-horizontal. When the arms 49 of the rams 74, 75 are retracted into the bodies 48, an opposite force is applied to the wheel housing 33 causing the guide followers 36 to again follow the path of travel through the arcuate guide 34 bringing the guide wheel 22 back to a position wherein the axis of rotation is substantially horizontal.

In a particularly preferred embodiment shown in FIGS. 9 through 11, each of the guides 34 of the pivoting member 15 are arcuate and are indirectly joined to the vehicle 3 by being directly connected to opposite ends of the carriage member 65. The carriage member is capable of lateral movements relative to the vehicle 3, i.e., movements perpendicular to the direction of travel. The carriage member 65 is slidably engaged with a carriage guide 66. The carriage guide 66 is joined to the chassis 19 of the vehicle 3. The carriage 65 comprises a carriage-guide follower 77 which together with the carriage guide 66 allows for lateral movement of the carriage 65.

In a preferred embodiment, the pivoting member 15 is dynamically linked to the main wheels to aid in guiding the vehicle about a curve or at a branch. One such vehicle is shown in FIGS. 9 through 11. The linkage system shown in herein is illustrative and is not intended to limit the scope of the invention.

The carriage member 65 comprises tie-rod brackets 17 for connection of pivoting member tie-rods 20. A tie-rod 20 is connected to each bracket 17 such that the tie-rod may pivot or swivel relative to the bracket 17. The other ends of the tie-rods 20 are connected to tie-rod brackets 17 which are joined to the axle housings 14 of the main wheelsets 55. The wheelset tie-rods 21 and the pivoting member tie-rods are connected to the tie-rod brackets 17 such that the tie-rods 20, 21 may swivel or pivot relative to the tie-rod brackets 17. The wheelset tie-rods 21 are configured to cause equal and opposite pivoting (yawing) movement of the wheelsets 55 when a switch or track curve is encountered. The pivoting member tie-rods 20 are configured to cause pivoting (yawing) movement of the wheelsets 55 when the carriage member 65 has been shifted laterally in either direction by either of the guide wheels 22.

When the guide wheels 22 return to a substantially horizontal axis, the tie-rods 20, 21 assist in shifting the carriage member 65 back to a central position when the main wheelsets 55 have returned to normal, i.e., non-yawing, positions.

In an embodiment wherein the track is provided with a guide rail in the area of a curve in the track, the guide wheel may be pivoted to a non-horizontal axis, causing shifting of the carriage member 65. The shifting of the carriage member 65 will cause main wheelsets 55 to yaw and will also provide additional stability to the vehicle as it moves along the curve in the tracks. As used herein the term "guiding the vehicle" shall refer to directing a vehicle to switch from one path of travel on a fixed guideway to an alternate path of travel on the fixed guideway, and may also refer to providing additional stability to the vehicle as it moves along a curve in the tracks. As used herein the term "bend" shall refer to any curvature in the direction of the tracks, e.g., the curvature formed when a branch track diverges from the main track, the curvature formed in a bowed length of track, or the like.

Illustrative, but non-limiting, examples of railway vehicles suitable for use with the guidance device of the present invention, are shown in FIGS. 1 through 7. The vehicle 3 basically comprises a body 5 mounted upon two railway trucks 18. Each of the trucks 18 comprises a chassis 19 and main wheels 9 mounted to the chassis 19. The chassis 19 is any member capable of supporting the main wheels 9. Preferably, the chassis 19 is also capable of supporting the guidance device of the present invention.

Figure 2:
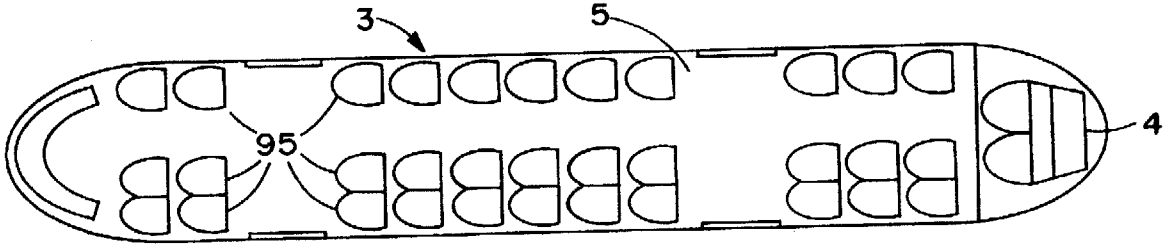
FIG. 2 is a top cut-away view of the railway vehicle of FIG. 1 showing the interior passenger space of the vehicle.
Figure 4:
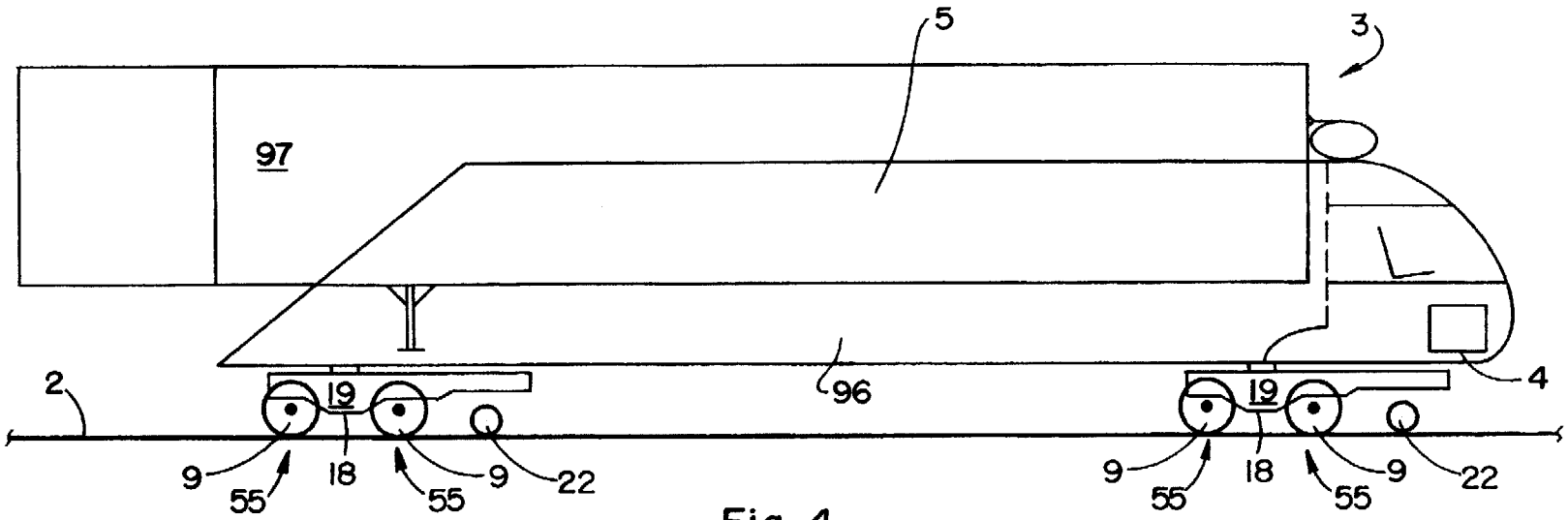
FIG. 4 is a schematic, side view of an alternately preferred railway vehicle embodiment comprising the guidance device of the present invention.
Figure 5:
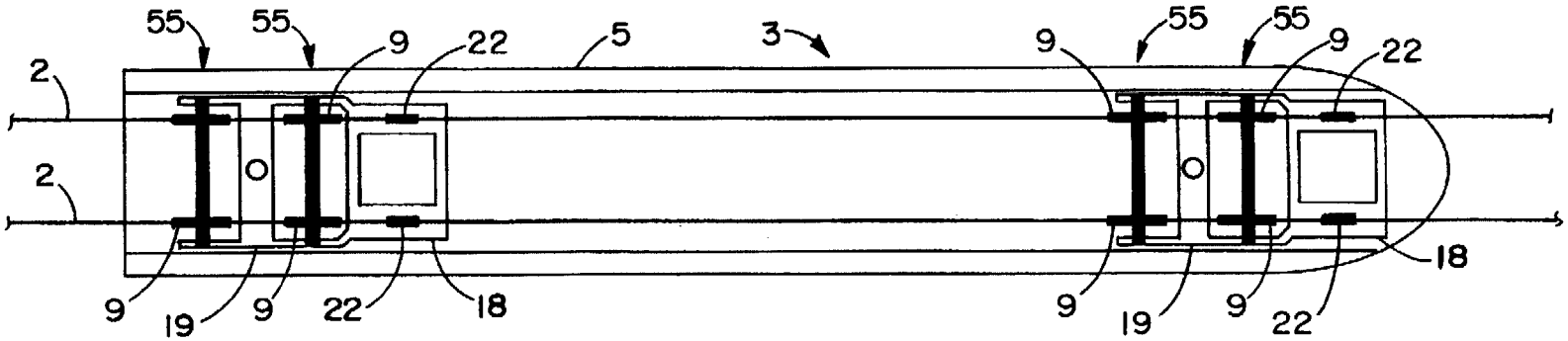
FIG. 5 is a bottom view of the railway vehicle of FIG. 4 showing the trucks of the vehicle, each of which comprises a guidance device of the present invention joined thereto.

FIGS. 1 through 3 show schematic side, top, and bottom views, respectively, of a preferred railway vehicle embodiment comprising the guidance device of the present invention. The railway vehicle of FIGS. 1–3 is intended for passenger travel and, for that purpose comprises a series of seats 95. The vehicle is also self-propelled and comprises a drive motor 4. FIGS. 4 and 5 show a schematic side and bottom view, respectively, of an alternately preferred railway vehicle embodiment comprising the guidance device of the present invention. The railway vehicle of FIGS. 4 and 5 is intended for transportation of goods and comprises a platform area 96 for storage of a container 97.

A preferred embodiment of the railway vehicle 3 of the present invention, railway truck 18, is shown in FIGS. 9 through 11. The railway truck 18 of FIG. 9 basically comprises a chassis 19, main wheels 9 mounted to the chassis for rotation about a horizontal axis, a pivoting member 15 joined to the chassis 19, and a guide wheel 22 mounted to the pivoting member 15 for rotation about an axis. In a preferred embodiment, the railway truck 18, will comprise at least two pivoting members positioned on opposite longitudinal sides of the chassis 19 and will comprise at least one guide wheel 22 mounted to each of the pivoting members 15 for rotation about an axis. In alternate embodiments of the present invention, each pivoting member may have two or more guide wheels mounted thereto.

Referring to FIG. 9 in detail, the chassis 19 comprises a pair of longitudinal sides 56 joined by a transversely oriented cross member 57. The cross member 57 supports a central pin or bolster 10 to which is mounted the body 5 of the vehicle 3. The main wheels 9 are mounted to the chassis 19 for rotation about a horizontal axis. The main wheels 9 are in sets, referred to as wheelsets 55. There are two main wheel sets 55 comprising axles 54 and main wheels 9, extending transversely between the longitudinal sides 56. The axles 54 are mounted to the longitudinal sides 56 by means of resilient bearings 16 which allow the axles 54 to rotate freely with a minimum of friction and wear. Each of the main wheel sets 55 are enclosed by an axle housings 14. The axle housings 14 will comprise tie-rod brackets 17 for connection of the wheelset tie-rods 21 and the pivoting-member tie-rods 20 which will be discussed in greater detail herein below. The guidance device of the present invention is joined to the vehicle by joining the pivoting members 15 to the chassis 19.

Although the preferred embodiments shown and described herein have the guidance device joined to the vehicle 3 by affixing the device to the trucks 18, it will be apparent to one skilled in the art that it may also be suitable to affix the guidance device to other parts of the vehicle 3.

One skilled in the art will recognize the truck 18 as a radial-axle type vehicle. A radial-axle type vehicle is one wherein the wheelsets are capable of yawing motion when the vehicle encounters a curve in the tracks, i.e., the axles of the wheelsets are capable of pivoting on a horizontal plane such that the wheelsets will maintain a radial orientation relative to the center of curvature of the track. Although it is preferable that the railway truck be of the radial-axle type, railway vehicles having rigid main wheelsets may also be suitable for use with the vehicle-controlled switching arrangement of the present invention.

It will be apparent to one skilled in the art that the vehicle-controlled guidance device of the present invention may be used with vehicles of various designs. Therefore, the railway vehicles described herein are preferred embodiments and provided for illustrative purposes. They are not intended to limit the scope of the invention. Examples of railway vehicles which may be suitable for use with the vehicle-controlled guidance device of the present invention include those disclosed in U.S. Pat. No. 2,879,718, issued Mar. 31, 1959 to Eksergian; U.S. Pat. No. 4,295,428, issued Oct. 20, 1981 to Dickhart, III et al.; U.S. Pat. No. 4,300,454, issued Nov. 17, 1981 to Scheffel; U.S. Pat. No. 4,428,301, issued Jan. 31, 1984 to Jackson; U.S. Pat. No. 4,512,261, issued Apr. 23, 1985 to Horger; U.S. Pat. No. 4,526,107, issued Jul. 2, 1985 to Mauntner et al.; and U.S. Pat. No. 5,131,332, issued Jul. 21, 1992 to Smith. Each of these patents is incorporated herein by reference.

Existing railway tracks having tack-based switching devices, can be converted for use with the guidance device of the present invention by removing the existing switch, i.e., the movable tack sections at the switch, and replacing them with the main rails and guide rails discussed hereinbefore. Alternatively, the existing railway track can be converted for use with the guidance device of the present invention by installing prior to or after (i.e., up-track from or down-track from) the existing switch, a duplicate switch comprising the main rails and guide rails discussed hereinbefore. In this manner, conventional track-based railway switching may be combined with the switching system of the present invention.

In an alternate drive member embodiment of the present invention shown in FIGS. 25 and 26, the drive member 72 comprises a threaded worm screw 60 which meshes with a complementary series of gear teeth, or a worm gear 61. The worm gear 61 is joined to the frame 32 of the pivoting member 15 such that as the worm screw 60 turns or rotates about its axis, the worm gear 61 of the frame 32 will be moved about an axis perpendicular to the axis of the worm screw 60. The worm screw 60 may be turned by any means of imparting rotary motion. Preferably, the worm screw 60 is turned by a rotary drive motor 62. The rotary drive motor 62 may be any means of imparting a rotary motion to the worm screw 60. For example, the rotary drive motor 62 may be an electric motor, a hydraulic motor/pump, or the like. The worm screw 60 preferably comprises a single or multi-start, trapezoidal-form screw thread.

FIG. 27 shows an alternate embodiment of the guidance device of the present invention. In the embodiment shown in FIG. 27, the guide rail 7 is positioned between the main rails 2 of the track 45, and the guide wheel 22 and pivoting member 15 are positioned between the main wheels 9 of the vehicle 3. The drive member 72 comprises a series of worm screws 60 arranged such that each of the worm screws 60 will contact the worm gear 61 joined to the frame 32 of the pivoting member 15. The worm screws 60 are connected to each other by bevel gears 59 which are driven by a rotary drive motor 62 also connected by a bevel gear 59.

Although in a preferred embodiment the guide rails are intermittent and are selectively positioned in the area of a bend (i.e., the area of a switch, the area of a curve, or the like) the guide rails may extend throughout the entire length of the tracks. In such an embodiment, it would be possible for the guide wheels to rotate about a non-horizontal axis throughout the vehicles travel upon the rails and for one or the other guide wheel to be selectively pivoted to rotation about a substantially horizontal axis in the area of a switch.

For example, if it is desired that the vehicle be guided to a branch which diverges to the left at a switch, then the guide wheel(s) on the right-side of the vehicle would be pivoted to rotation about a substantially horizontal axis and the guide wheel(s) on the left-side of the vehicle would remain rotating about a non-horizontal axis. Alternatively, if it is desired that the vehicle be guided to a branch which diverges to the right at a switch, then the guide wheel(s) on the left-side of the vehicle would be pivoted to rotation about a substantially horizontal axis and the guide wheel(s) on the right-side of the vehicle would remain rotating about a non-horizontal axis.

What is claimed is:

1. A guidance device for a track-following vehicle intended for use with a track comprising a first main rail, a second main rail parallel to the first main rail, and a first guide rail, the first guide rail being substantially circular in cross-section, having a centerpoint, and being substantially parallel to the first main rail and the second main rail, said guidance device comprising:

a first guide wheel, having a circumference comprising a guide portion which is complementary with the first guide rail; and a first pivoting member, said first guide wheel being mounted to said first pivoting member for rotation about an axis such that said guide portion of said first guide wheel is aligned with the first guide rail, said first pivoting member being capable of pivoting said first guide wheel from rotation about a substantially horizontal axis to rotation about a non-horizontal axis while maintaining a substantially radial orientation relative to the centerpoint of the first guide rail.

2. The guidance device of claim 1 wherein said first pivoting member comprises an arcuate guide, a guide follower which follows the arcuate guide, and a frame joined to said guide follower, said first guide wheel being mounted to said frame for rotation about an axis.

3. The guidance device of claim 2 additionally comprising a drive member which imparts a vector force to said frame of said first pivoting member to cause the pivoting of said first guide wheel about the first guide rail.

4. The guidance device of claim 3 wherein said drive member comprises at least one hydraulic ram.

5. The guidance device of claim 4 wherein said drive member comprises a series of double-acting hydraulic rams.

6. The guidance device of claim 3 wherein said drive member comprises a threaded worm screw which meshes with a complementary series of gear teeth joined to said frame of said first pivoting member and arranged arcuately, said threaded worm screw being connected to a rotary drive motor.

7. A track-following vehicle intended for use with a track comprising a first main rail, a second main rail parallel to the first main rail, and a first guide rail joined to the first main rail, the first guide rail of the track being substantially parallel to the first main rail, being substantially circular in cross-section, and having a centerpoint, said vehicle comprising:

a chassis having longitudinal sides;

main wheels mounted to said chassis for rotation about a horizontal axis;

a first guide wheel having a circumference comprising a guide portion which is complementary with the first guide rail; and a first pivoting member joined to said vehicle, said first guide wheel being mounted to said first pivoting member for rotation about an axis such that said guide portion of said first guide wheel is aligned with the first guide rail, said first pivoting member being capable of pivoting said first guide wheel from rotation about a substantially horizontal axis to rotation about a non-horizontal axis while maintaining a substantially radial orientation relative to the centerpoint of the first guide rail.

8. The track-following vehicle of claim 7 wherein said first guide wheel additionally comprises a support portion joined to said guide portion, said support portion being positioned laterally inboard of said guide portion and being aligned with the first main rail of the track.

9. The track-following vehicle of claim 7 comprising a plurality of guide wheels each having a circumference comprising a guide portion which is complementary with the first guide rail and each being mounted to said first pivoting member for rotation about an axis such that said guide portion of each of said guide wheels is aligned with the first guide rail.

10. The track-following vehicle of claim 9 wherein each of said guide wheels additionally comprises a support portion joined to said guide portion, said support portion being positioned laterally inboard of said guide portion and being aligned with the first main rail of the track.

11. The track-following vehicle of claim 7 wherein said guide portion of said first guide wheel is substantially arcuate.

12. The track-following vehicle of claim 7 wherein said guide portion of said first guide wheel is substantially V-shaped.

13. The track-following vehicle of claim 12 wherein said guide portion of said first guide wheel is a composite comprising a first circular disk having a circumference which is beveled and a second circular disk having a circumference which is beveled opposite to said first circular disk, said second circular disk being joined in facing relation to said first circular disk such that the resultant guide portion is substantially V-shaped.

14. The track-following vehicle of claims 13 wherein said first circular disk is held in facing relation with said second circular disk by means of a plurality of fastening members and compression springs which allow said first circular disk to move axially relative to said second circular disk.

15. A track-following vehicle, intended for use on a track comprising a first main rail, a second main rail parallel to the first main rail, a first guide rail joined to the first main rail, and a second guide rail joined to the second main rail, the first guide rail of the track being substantially parallel to the first main rail, being substantially circular in cross-section, and having a centerpoint, the second guide rail of the track being substantially parallel to the second main rail, being substantially circular in cross-section, and having a centerpoint, said vehicle comprising:

a chassis having longitudinal sides;

main wheels mounted to said chassis for rotation about a horizontal axis;

a first guide wheel having a circumference comprising a guide portion which is complementary with the first guide rail;

a second guide wheel having a circumference comprising a guide portion which is complementary with the second guide rail;

a first pivoting member joined to said vehicle, said first guide wheel being mounted to said first pivoting member for rotation about an axis such that said guide portion of said first guide wheel is aligned with the first guide rail, said first pivoting member being capable of pivoting said first guide wheel from rotation about a substantially horizontal axis to rotation about a non-horizontal axis while maintaining a substantially radial orientation relative to the centerpoint of the first guide rail; and a second pivoting member joined to said vehicle, said second guide wheel being mounted to said second pivoting member for rotation about an axis such that said guide portion of said second guide wheel is aligned with the second guide rail of the track, said second pivoting member being capable of pivoting said second guide wheel from rotation about a substantially horizontal axis to rotation about a non-horizontal axis while maintaining a substantially radial orientation relative to the centerpoint of the second guide rail.

16. The track-following vehicle of claim 15 wherein said first guide wheel additionally comprises a support portion joined to said guide portion, said support portion being positioned laterally inboard of said guide portion and being aligned with the first main rail of the track and said second guide wheel additionally comprises a support portion joined to said guide portion, said support portion being positioned laterally inboard of said guide portion and being aligned with the second main rail of the track.

17. The track-following vehicle of claim 15 wherein said main wheels are mounted on axles which pivot about a vertical axis and said first pivoting member and said second pivoting member are dynamically linked to said axles to assist in guiding said vehicle.

18. The track-following vehicle of claim 15 wherein said first pivoting member and said second pivoting member each comprises an arcuate guide joined to the vehicle, a guide follower which follows the arcuate guide, and a frame joined to the guide follower, said first guide wheel being mounted to said frame of said first pivoting member and said second guide wheel being mounted to said frame of said second pivoting member.

19. The track-following vehicle of claim 18 wherein said first pivoting member comprises a drive member comprising a series of double acting hydraulic rams which impart a vector force to said frame of said first pivoting member and said second pivoting member comprises a drive member comprising a series of double acting hydraulic rams which impart a vector force to said frame of said second pivoting member.

20. The track-following vehicle of claim 18 wherein said first pivoting member comprises a drive member comprising a threaded worm screw which meshes with a complementary series of gear teeth joined to said frame of said first pivoting member and arranged arcuately, and said second pivoting member comprises a drive member comprising a threaded worm screw which meshes with a complementary series of gear teeth joined to said frame of said second pivoting member and arranged arcuately.

21. A method of guiding a track-following vehicle intended for use with a guideway comprising a pair of horizontal running surfaces, and at least one substantially circular guide rail associated with and parallel to said horizontal running surfaces, the guide rail being located in at least the area of a bend in the guideway, said method comprising the steps of:

providing a first pivoting member joined to the track-following vehicle, said first pivoting member being capable of pivoting from a first position to a second position;

providing a first guide wheel having a circumference comprising a guide portion which is complementary with the guide rail, said first guide wheel being mounted to said first pivoting member for rotation about an axis and being positioned relative to the track-following vehicle and the guideway such that said circumference of said first guide wheel is in facing relation with the guide rail, said axis of rotation of said first guide wheel being substantially horizontal in said first position and said axis of rotation of said first guide wheel being non-horizontal in said second position; and pivoting said first pivoting member to said second position at about the bend such that said axis of rotation of said first guide wheel is non-horizontal and said first guide wheel will follow the guide rail.

22. A method of guiding a railway vehicle intended for use with a track comprising a first main rail, a second main rail parallel to the first main rail, and at least one substantially circular guide rail associated with and parallel to the first main rail and the second main rail and being located in at least the area of a bend in the track, said method comprising the steps of:

providing a first pivoting member joined to the railway vehicle, said first pivoting member being capable of pivoting from a first position to a second position;

providing a first guide wheel having a circumference comprising a guide portion which is complementary with the guide rail, said first guide wheel being mounted to said first pivoting member for rotation about an axis and being positioned relative to the railway vehicle and the track such that said circumference of said first guide wheel is in facing relation with the guide rail, said axis of rotation of said first guide wheel being substantially horizontal in said first position and said axis of rotation of said first guide wheel being non-horizontal in said second position; and pivoting said first pivoting member to said second position at about the bend such that said axis of rotation of said first guide wheel is non-horizontal and said first guide wheel will follow the guide rail.

* * * * *